US012420136B2

(12) United States Patent
Koyama

(10) Patent No.: US 12,420,136 B2
(45) Date of Patent: Sep. 23, 2025

(54) LOAD TRANSMISSION MECHANISM UNIT FOR TRAINING DEVICE, AND TRAINING DEVICE USING SAME

(71) Applicant: World Wing Enterprise Co., Ltd., Tottori (JP)

(72) Inventor: Yasushi Koyama, Tottori (JP)

(73) Assignee: World Wing Enterprise Co., Ltd., Tottori (JP)

( * ) Notice: Subject to any disclaimer, the term of this patent is extended or adjusted under 35 U.S.C. 154(b) by 31 days.

(21) Appl. No.: 18/540,404

(22) Filed: Dec. 14, 2023

(65) Prior Publication Data

US 2024/0108941 A1 Apr. 4, 2024

Related U.S. Application Data

(63) Continuation of application No. PCT/JP2021/048581, filed on Dec. 27, 2021.

(30) Foreign Application Priority Data

Aug. 16, 2021 (JP) ..... 2021-132129

(51) Int. Cl.
*A63B 21/00* (2006.01)
*A63B 21/062* (2006.01)

(52) U.S. Cl.
CPC ..... *A63B 21/4049* (2015.10); *A63B 21/0628* (2015.10); *A63B 21/151* (2013.01); *A63B 21/4035* (2015.10)

(58) Field of Classification Search
CPC ... A63B 21/062; A63B 21/0628; A63B 21/15; A63B 21/151; A63B 21/4035;
(Continued)

(56) References Cited

U.S. PATENT DOCUMENTS 7,686,746 B2 * 3/2010 Koyama ..... A63B 23/14 482/92
7,892,153 B2 * 2/2011 Koyama ..... A63B 21/4047 482/148
(Continued)

FOREIGN PATENT DOCUMENTS

CN 101048204 A * 10/2007 ..... A63B 21/0628
CN 101791464 8/2010
(Continued)

OTHER PUBLICATIONS

International Search Report dated Mar. 29, 2022, in counterpart International Application No. PCT/JP2021/048581, along with English translation.
(Continued)

*Primary Examiner* — Gary D Urbiel Goldner
(74) *Attorney, Agent, or Firm* — DLA Piper LLP (US)

(57) ABSTRACT

A load transmission mechanism unit for a training device includes, in a housing portion: a grip shaft portion rotatable with a grip portion connected to a first end portion thereof; an intermediate shaft portion rotatable with the rotation of the grip shaft portion; a transmission portion suspended between the grip shaft portion and the intermediate shaft portion and transmitting a mutual rotation of the grip shaft portion and the intermediate shaft portion; a rotation conversion portion provided on a crank shaft portion transmitting the rotation of the intermediate shaft portion; and the crank shaft portion converting the rotation of the crank shaft portion into a vertical movement of a sliding shaft portion. The first end portion of the grip shaft portion is swingably supported by the housing portion, and a second end portion of the grip shaft portion swings within a shaft opening portion formed in the housing portion.

14 Claims, 23 Drawing Sheets

(58) Field of Classification Search
CPC ..... A63B 21/4049; A63B 23/03533; A63B 23/12; A63B 23/1218; A63B 23/14; A63B 2023/003
See application file for complete search history.

(56) References Cited

U.S. PATENT DOCUMENTS

| | | | | |
|---|---|---|---|---|
| 2004/0157711 | A1* | 8/2004 | Regev | A63B 21/06 482/133 |
| 2007/0287607 | A1 | 12/2007 | Koyama | |
| 2010/0204022 | A1* | 8/2010 | Koyama | A63B 21/4045 482/100 |
| 2025/0135262 | A1* | 5/2025 | Koyama | A63B 23/035 |

FOREIGN PATENT DOCUMENTS

| | | | | |
|---|---|---|---|---|
| CN | 205683502 | | 11/2016 | |
| CN | 107648807 | A * | 2/2018 | A63B 21/05 |
| CN | 111714841 | | 9/2020 | |
| JP | 2000-014855 | | 1/2000 | |
| JP | 2006-110226 | | 4/2006 | |
| JP | 2006-187317 | | 7/2006 | |
| JP | 2012-236009 | | 12/2012 | |
| JP | 3201283 | | 12/2015 | |
| KR | 100817827 | B1 * | 3/2008 | A63B 21/0628 |
| KR | 101532302 | B1 | 6/2015 | |

OTHER PUBLICATIONS

Office Action for Taiwanese Patent Application No. 110149243 dated Dec. 13, 2022, along with English translation.
Office Action dated Jun. 26, 2025, from counterpart Korean Patent Application No. 10-2023-7043113.
Extended European Search Report dated Jul. 2, 2025, from counterpart European Patent Application No. 21954286.7.

* cited by examiner

LOAD TRANSMISSION MECHANISM UNIT FOR TRAINING DEVICE, AND TRAINING DEVICE USING SAME

TECHNICAL FIELD

The present disclosure relates to a load transmission mechanism unit for training device and training device using the same.

BACKGROUND

There are various types of training device for training portions such as the arms and the shoulders of a user. For example, Japanese Unexamined Patent Application Publication No. 2006-187317 discloses training device that allows exercise of both arms. According to the training device described in JP 2006-187317A, it is possible to obtain shoulder and back muscles and the like without hardening of the muscles, with less burden on the body such as muscle pain and fatigue, and with flexibility and elasticity.

The training device of JP 2006-187317A includes a load transmission mechanism unit that includes a rotating shaft called a lifting/lowering and swinging member, gears and the like between a wire extending from a weight on the training device side and a grip portion that a user grips. Compared to training device in which the wire on the weight side is simply connected to the grip portion that the user grips, the training device of JP 2006-187317A includes the lifting/lowering and swinging member (the load transmission mechanism unit), and thus complicated movements such as twisting are applied to the arm muscles that the user tries to train. For this reason, it is not limited to training of the muscles in a monotonic direction, and the muscles around the arm bones are moved more, and thus it possible to train the muscles with increased flexibility.

There is nonetheless a need for a load transmission mechanism unit for a training device that can apply complex movements to the muscles that the user tries to train by increasing the degree of freedom of movement of a shaft that constitutes the load transmission mechanism unit and training device using the same.

I thus provide a load transmission mechanism unit for a training device that includes, in a housing portion: a grip shaft portion that rotates with a grip portion, which is gripped by a user, connected to a first end portion thereof; an intermediate shaft portion that rotates in conjunction with the rotation of the grip shaft portion; a transmission portion that is suspended between the grip shaft portion and the intermediate shaft portion and transmits the mutual rotation of the grip shaft portion and the intermediate shaft portion; a rotation conversion portion that is provided on a crank shaft portion orthogonal to the intermediate shaft portion and transmits the rotation of the intermediate shaft portion; and the crank shaft portion that converts the rotation of the crank shaft portion into a vertical movement of a sliding shaft portion disposed at a position parallel to the intermediate shaft portion, wherein the first end portion of the grip shaft portion protrudes from a shaft opening portion formed in the housing portion in a direction orthogonal to the transmission portion, and wherein the first end portion of the grip shaft portion is swingably supported by the housing portion, and a second end portion of the grip shaft portion on a side opposite to the first end portion swings within the shaft opening portion.

The rotation conversion portion may include an intermediate shaft bevel gear that is provided on the intermediate shaft portion, and a crank shaft bevel gear that is provided on the crank shaft portion and meshes with the intermediate shaft bevel gear, and a connecting piece portion that is rotatably connected to the crank shaft portion, and the sliding shaft portion that is connected to the connecting piece portion and is disposed at a position parallel to the intermediate shaft portion and through which the rotation of the crank shaft portion is converted into a back-and-forth movement via the connecting piece portion may be accommodated in the housing portion.

The housing portion may include a regulating plate portion that regulates a swing of the grip shaft portion on the first end portion in the shaft opening portion.

The regulating plate portion may include a claw portion and may engage with the grip shaft portion through the claw portion. Further, the regulating plate portion may advance toward the shaft opening portion and may engage with the grip shaft portion through the claw portion, and the regulating plate portion may retreat from the shaft opening portion and may disengage from the first end portion of the grip shaft portion.

The transmission portion may be a transmission chain, the grip shaft portion may include a grip shaft sprocket, the intermediate shaft portion may include an intermediate shaft sprocket, and the transmission chain may be suspended between the grip shaft sprocket and the intermediate shaft sprocket.

There may be further provided a biasing shaft portion that biases tension of the transmission portion between the grip shaft portion and the intermediate shaft portion.

The biasing shaft portion may include a disk portion that is in contact with the transmission portion.

The grip portion may be an annular object, or the grip portion may be a semi-cylindrical object.

The second end portion of the grip shaft portion may include a spherical portion.

The sliding shaft portion may be connected to a load applying portion that can adjust a magnitude of a load of training device.

The housing portion may include a connection portion for connecting to training device.

Therefore, a load transmission mechanism unit for a training device includes, in a housing portion: a grip shaft portion that rotates with a grip portion, which is gripped by a user, connected to a first end portion thereof; an intermediate shaft portion that rotates in conjunction with the rotation of the grip shaft portion; a transmission portion that is suspended between the grip shaft portion and the intermediate shaft portion and transmits the mutual rotation of the grip shaft portion and the intermediate shaft portion; a rotation conversion portion that is provided on a crank shaft portion orthogonal to the intermediate shaft portion and transmits the rotation of the intermediate shaft portion; and the crank shaft portion that converts the rotation of the crank shaft portion into a vertical movement of a sliding shaft portion disposed at a position parallel to the intermediate shaft portion, wherein the first end portion of the grip shaft portion protrudes from a shaft opening portion formed in the housing portion in a direction orthogonal to the transmission portion, and wherein the first end portion of the grip shaft portion is swingably supported by the housing portion, and a second end portion of the grip shaft portion on a side opposite to the first end portion swings within the shaft opening portion, and thus it is possible to apply complex movements to the arm muscles that the user tries to train by increasing the degree of freedom of movement of a shaft that constitutes the load transmission mechanism unit. At the same time, with use of training device using the load transmission mechanism unit for training device according to the present disclosure, training can be performed according to the user's wishes.

BRIEF DESCRIPTION OF THE DRAWINGS

Features, advantages, and technical and industrial significance of examples of the disclosure will be described below with reference to the accompanying drawings, in which like numerals denote like elements.

REFERENCE SIGNS LIST

Figure 1:
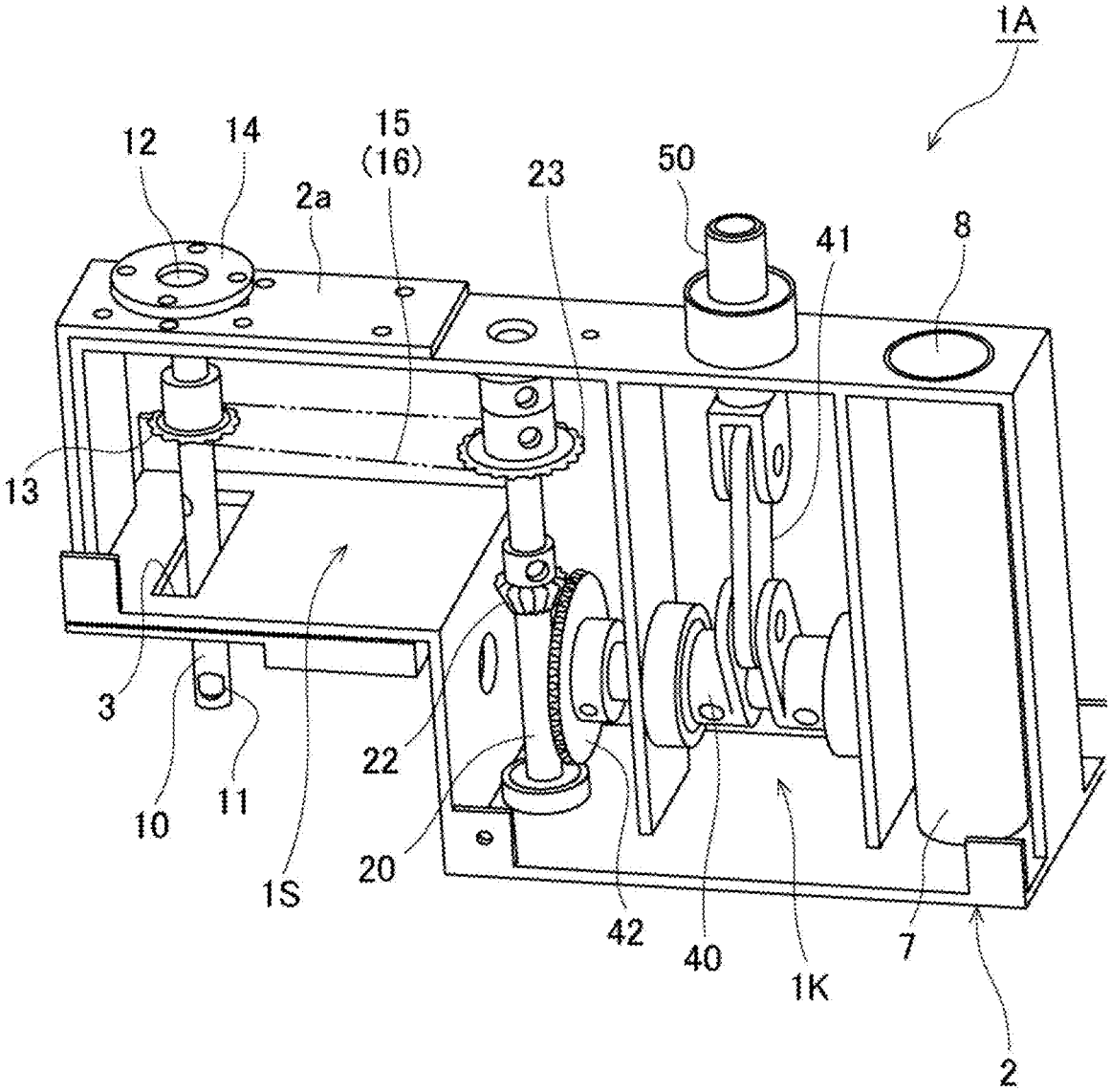
FIG. 1 is a side perspective view showing an internal configuration of a load transmission mechanism unit for training device according to a first example.

1A, 1B, 1C Load transmission mechanism unit for training device
2 Housing portion
3 Shaft opening portion
4 Swing opening portion
5, 5*w* Regulating plate portion
5*e*, 5*f* Claw portion
6 Slide holding portion
7 Connection portion
8 Connection tube portion
9 Roller
10 Grip shaft portion
11 First end portion
12 Second end portion
12*r* Spherical portion
13 Grip shaft sprocket
14 Swing holding plate portion
15 Transmission portion
16 Transmission chain
20 Intermediate shaft portion
22 Intermediate shaft portion bevel gear
23 Intermediate shaft sprocket
30 Biasing shaft portion
31 Disk portion
40 Crank shaft portion
41 Connecting piece portion
42 Crank shaft bevel gear
50 Sliding shaft portion
1S Rotation transmission unit
1K Crank mechanism unit
100, 200 Training device
130, 230 Load applying portion
160, 260 Grip portion

DETAILED DESCRIPTION

Load transmission mechanism units for training device 1A, 1B, and 1C disclosed in FIGS. 1, 2, and 6 to 9 are connected to training device 100 or 200 which will be described below. The load transmission mechanism units for training device 1A, 1B, and 1C are mechanical members that are equipped with a mechanism for transmitting a load such as a weight of the training device to a user of the training device.

Figure 2:
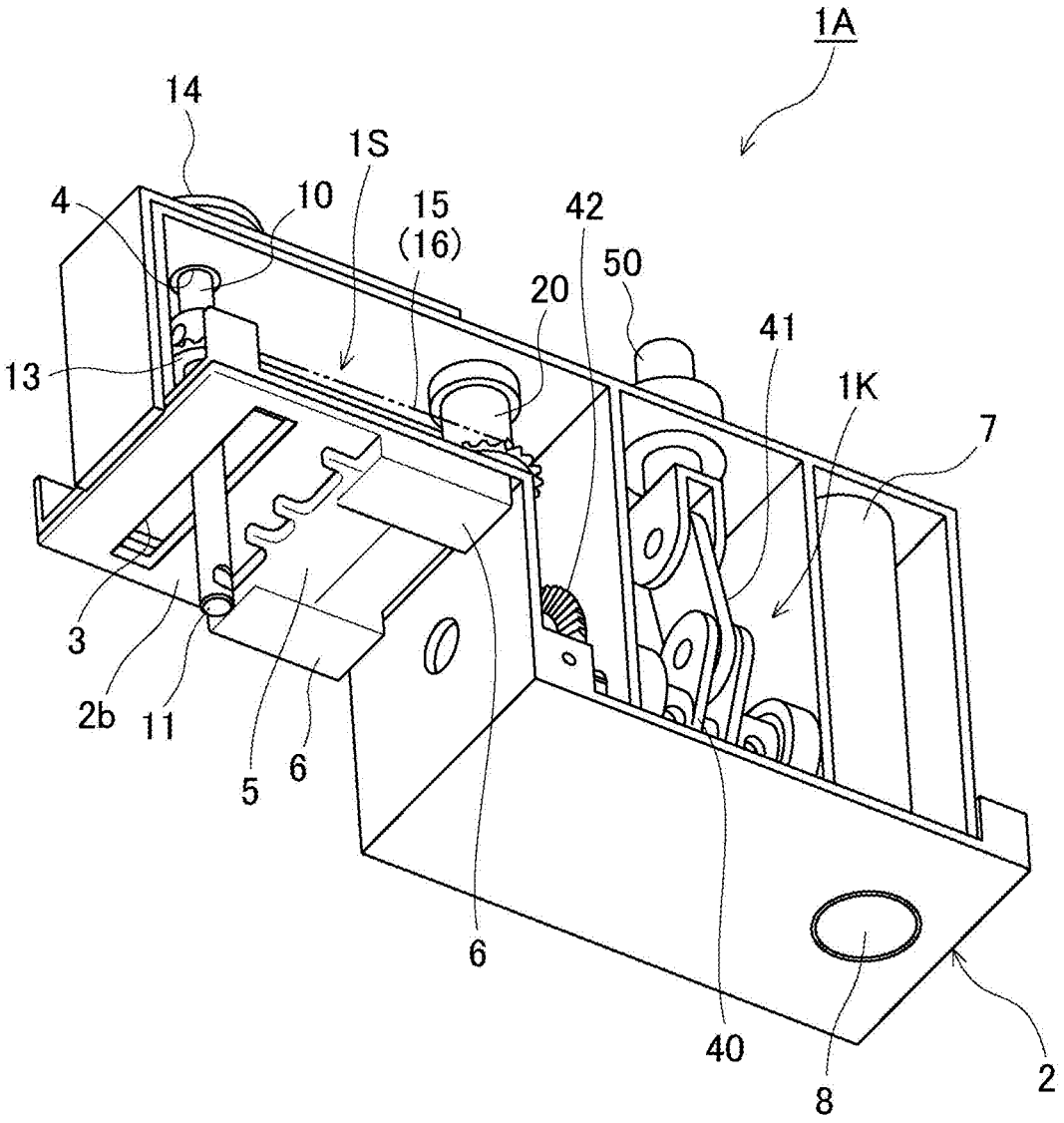
FIG. 2 is a side perspective view from a lower side of FIG. 1.

Load Transmission Mechanism Unit for a Training Device According to a First Example FIGS. 1 and 2 are perspective views showing an internal structure of the load transmission mechanism unit 1A for training device according to a first example. The load transmission mechanism unit 1A for training device includes a grip shaft portion 10, an intermediate shaft portion 20, a crank shaft portion 40, and a sliding shaft portion 50 in a housing portion 2. It is possible to transmit power between the grip shaft portion 10 and the sliding shaft portion 50 via the shaft portions between the grip shaft portion 10 and the sliding shaft portion 50.

In the load transmission mechanism unit 1A for training device of the first example, the shaft portions of the intermediate shaft portion 20, the crank shaft portion 40, and the sliding shaft portion 50 are rotatably supported by the housing portion 2. As understood from FIGS. 1 and 2, the shaft portions are supported by an upper surface 2*a* and a lower surface 2*b* of the housing portion 2, and further by an inner surface portion of the housing portion 2. For smooth rotation, appropriate bearings are interposed at the supporting points. Furthermore, the housing portion 2 includes a connection portion 7 to connect the load transmission mechanism unit 1A for training device of the first example to the training device 100 (see FIG. 9) which will be described below. The connection portion 7 of the load transmission mechanism unit 1A for training device employs a form of a cylindrical connection tube portion 8. A guide column 140 (see FIG. 10) is inserted into the connection tube portion 8. For the connection tube portion 8, a member having low sliding resistance such as a fluororesin, is used, for example. As a result, the load transmission mechanism unit 1A for training device can be smoothly lifted and lowered and turned in the training device 100.

Figure 10:
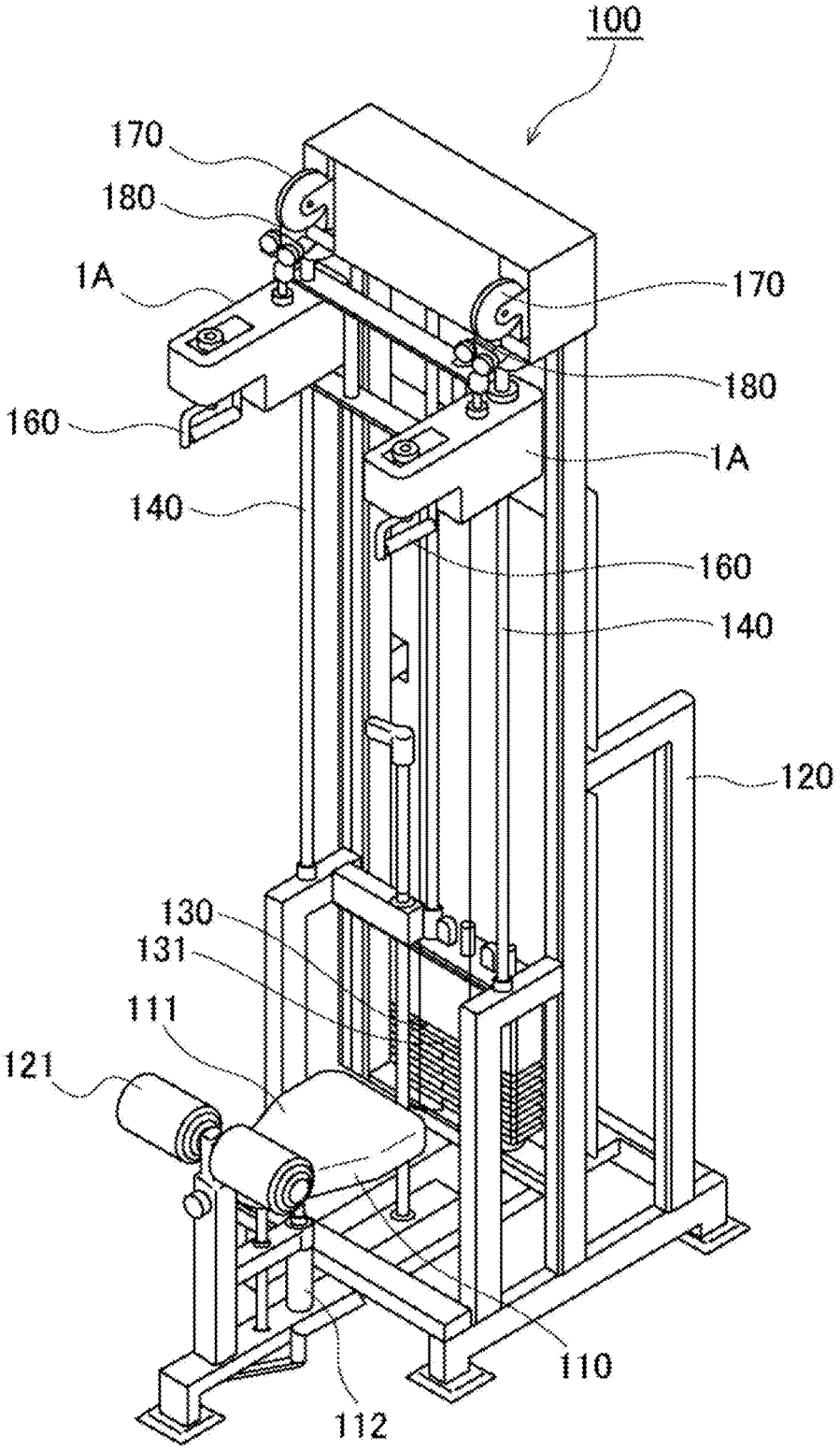
FIG. 10 is a perspective view of first training device.

The grip shaft portion 10 includes a first end portion 11 and a second end portion 12, and a grip portion 160 (see FIG. 10) that is gripped by a user is connected to the first end portion 11. The movements of the user's hands and arms are transmitted to the grip shaft portion 10 via the grip portion 160, and the grip shaft portion 10 itself also rotates. As can be understood from the training device 100 which will be described below, the grip portion 160 connected to the grip shaft portion 10 is gripped by an annular object, particularly the fingers of a hand, and thus has a rectangular annular shape. As shown in FIG. 10, the grip portion 160 has a rectangular (square) shape in a plan view, and forms a continuous ring.

The intermediate shaft portion 20 rotates in conjunction with the rotation of the grip shaft portion 10. A transmission portion 15 that is suspended between the grip shaft portion 10 and the intermediate shaft portion 20 and transmits the mutual rotation of the grip shaft portion 10 and the intermediate shaft portion 20 is provided. The grip shaft portion 10 and the intermediate shaft portion 20 are disposed parallel to each other. The connection between the grip shaft portion 10 and the housing portion 2 will be explained with reference to FIGS. 4A and 4B, which will be described below. Both ends of the intermediate shaft portion 20 are supported by the wall surface of the housing portion 2.

In the load transmission mechanism unit 1A for training device, the transmission portion 15 is a transmission chain 16 (indicated by a two-dot chain line in FIG. 1). For suspension and engagement of the transmission chain 16 of the transmission portion 15, the grip shaft portion 10 includes a grip shaft sprocket 13, and the intermediate shaft portion 20 includes an intermediate shaft sprocket 23. The transmission portion 15 may be a combination of a belt and a pulley (not shown) instead of employing the transmission chain 16.

As illustrated, the intermediate shaft portion 20 and the crank shaft portion 40 are in an orthogonal relationship to each other, and the intermediate shaft portion 20 and the crank shaft portion 40 include a rotation conversion portion that transmits the rotation of the intermediate shaft portion 20. In this example, the rotation conversion portion includes an intermediate shaft bevel gear 22 that is provided on the intermediate shaft portion 20 and a crank shaft bevel gear 42 that is provided on the crank shaft portion 40 and meshes with the intermediate shaft bevel gear 22. Therefore, the rotational movement of the intermediate shaft portion 20 is in conjunction with the crank shaft portion 40 at right angles. Examples of a mechanism of the rotation conversion portion that orthogonally connects the intermediate shaft portion and the crank shaft portion to each other include a combination of a crown gear and a spur gear, a worm and a worm wheel and the like.

A connecting piece portion 41 is connected to the crank shaft portion 40. The connecting piece portion 41 is rotatably connected to a connecting portion with the connecting piece portion 41 protruding from the crank shaft portion 40. Further, the distal end of the sliding shaft portion 50 is rotatably connected to the connecting piece portion 41. The sliding shaft portion 50 is disposed at a position parallel to the intermediate shaft portion 20. The rotation of the crank shaft portion 40 is converted into a vertical movement in the drawing via the connecting piece portion 41, and is transmitted to the sliding shaft portion 50. The sliding shaft portion 50 is connected to a load applying portion 130 that can adjust the magnitude of the load of the training device 100 (see FIG. 10).

As the crank shaft portion 40 rotates, the connecting piece portion 41 is also moved. Therefore, a vertical movement occurs in the sliding shaft portion 50 via the connecting piece portion 41. That is, the sliding shaft portion 50 moves up and down due to the rotation of the grip shaft portion 10 about its axis, and the load applying portion 130 (a weight) of the training device 100 (see FIG. 10) connected to the sliding shaft portion 50 moves up and down. In the load transmission mechanism unit 1A for training device, a rotation transmission unit 1S includes the grip shaft sprocket 13 provided on the grip shaft portion 10, the intermediate shaft sprocket 23, and the transmission portion 15 (the transmission chain 16) suspended between the grip shaft sprocket 13 and the intermediate shaft sprocket 23, the intermediate shaft bevel gear 22 provided on an intermediate shaft portion 20, and a crank shaft bevel gear 42 that meshes with the intermediate shaft bevel gear 22. As a result, the crank shaft portion 40 also rotates as the grip shaft portion 10 rotates.

In the load transmission mechanism unit 1A for training device, a crank mechanism unit 1K includes the crank shaft portion 40 and the connecting piece portion 41 of which one end side is rotatably connected to a protrusion protruding from the center of the crank shaft portion 40 and the other end side is rotatably connected to an end portion of the sliding shaft portion 50. As a result, the sliding shaft portion 50 advances and retreats as the crank shaft portion 40 rotates. In this way, the grip shaft portion 10 (the grip portion 160) is rotationally biased by a force proportional to the load of the load applying portion 130 (both see FIG. 10). Then, when the user rotates the grip portion 160 about its axis against a rotational biasing force with respect to the grip shaft portion 10, the sliding shaft portion 50 is drawn into the housing portion 2 via the rotation transmission unit 1S and the crank mechanism unit 1K, and the load applying portion 130 that is connected to the sliding shaft portion 50 is pulled (pulled up).

As a feature of the load transmission mechanism unit 1A for training device (1B and 1C, which will be described below) of the example, the grip shaft portion 10 is not completely supported by the housing portion 2, and an appropriate swing is allowed. As shown in the perspective view from a lower side of FIG. 2, a shaft opening portion 3 is formed in the lower surface 2*b* of the housing portion 2. In the example, the shaft opening portion 3 is opened in a direction orthogonal to the transmission portion 15 (a direction in which the transmission chain 16 is suspended). More specifically, in the example, the shaft opening portion 3 is opened in a direction orthogonal to a direction of the crank shaft portion 40. As can be understood from the illustration, the shaft opening portion 3 formed in the housing portion 2 has an elongated rectangular shape extending in a direction orthogonal to a longitudinal direction of the housing portion 2. The first end portion 11 of the grip shaft portion 10 protrudes from the shaft opening portion 3. In the grip shaft portion 10, the first end portion 11 is swingable in a length direction of an opening of the shaft opening portion 3 (a direction orthogonal to the transmission portion 15) using the second end portion 12 as a fulcrum (see FIG. 1).

Figure 3:
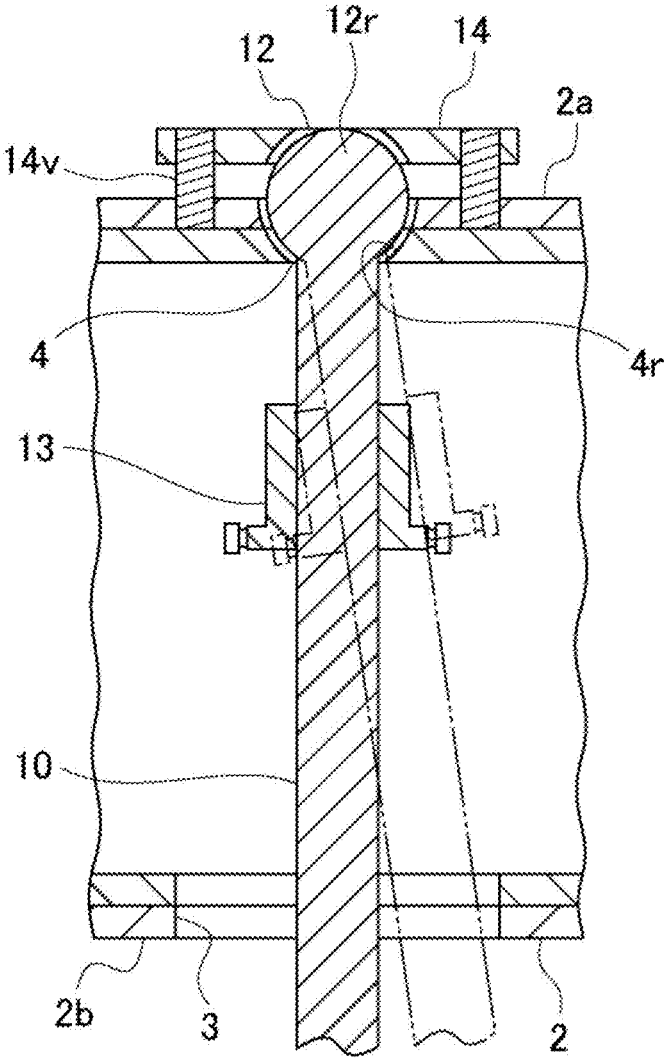
FIG. 3 is a schematic cross-sectional view of the vicinity of a grip shaft portion.

The schematic cross-sectional view of FIG. 3 shows the vicinity of the second end portion 12 of the grip shaft portion 10. A swing opening portion 4 through which the grip shaft portion 10 passes is formed in the housing portion 2. In the illustration, the second end portion 12 is inserted into the swing opening portion 4. A spherical portion 12*r* is formed at the second end portion 12 of the grip shaft portion 10. A sliding surface portion 4*r* corresponding to the spherical portion 12*r* is formed in the swing opening portion 4. That is, a ball joint is formed by the spherical portion 12*r* and the sliding surface portion 4*r*. To swingably hold the spherical portion 12*r* of the second end portion 12 of the grip shaft portion 10, a swing holding plate portion 14 covers the spherical portion 12*r*. To adjust the friction occurring when the spherical portion 12*r* smoothly slides on the sliding surface portion 4*r*, the spacing between the swing holding plate portion 14 and the housing portion 2 is adjusted by a spacing member 14*v*. Because of the connection structure of the ball joint between the spherical portion 12*r* and the sliding surface portion 4*r*, the grip shaft portion 10 can swing in an arc shape around the second end portion 12 (the spherical portion 12*r*) (see a double-dashed line in the figure). However, depending on the direction of the shaft opening portion 3, the swing of the first end portion 11 of the grip shaft portion 10 is restricted. In addition to the sliding configuration of the ball joint in the spherical portion 12*r* of the grip shaft portion 10 of the example, although not shown, a hole through which a shaft is inserted can be formed on the second end portion side of the grip shaft portion, and thus the hole described above can be made swingable via a shaft provided on the housing portion side. Further, to cope with the twisting that occurs in the grip shaft portion when the grip shaft portion swings, the grip shaft portion includes a turning mechanism such as a bearing.

Furthermore, as shown in the perspective view of FIG. 2, the load transmission mechanism unit 1A for training device includes a regulating plate portion 5 on the lower surface 2*b* of the housing portion 2. The regulating plate portion 5 regulates the swing of the grip shaft portion 10 on a side of the first end portion 11 in the shaft opening portion 3. In detail, schematic views of FIGS. 4A and 4B or FIGS. 5A and 5B are referred to. A difference between pairs of FIGS. 4A and 4B and FIGS. 5A and 5B is the number of claw portions, but the operation of the regulating plate portion itself is the same. The schematic view in FIG. 4A corresponds to the state in FIG. 2. The regulating plate portion 5 provided on the lower surface 2*b* of the housing portion 2 is slidably accommodated in a slide holding portion 6 on both sides in a left-right direction in the drawing (a retreated position). The regulating plate portion 5 includes a claw portion 5*e* protruding toward the shaft opening portion 3.

Subsequently, in the schematic view of FIG. 4B, the regulating plate portion 5 moves forward by sliding toward the shaft opening portion 3, and the claw portion 5*e* engages with the grip shaft portion 10 (an advanced position). In this example, the grip shaft portion 10 is sandwiched between the two claw portions 5*e* and does not move in the left-right direction in the drawing. In this way, the regulating plate portion 5 can easily shift between a state engaged with and a state disengaged from the grip shaft portion 10 by the sliding movement. In addition, when the regulating plate portion 5 is fixed at the forward-moved position, the regulating plate portion 5 is temporarily fixed to the lower surface 2*b* of the housing portion 2 with appropriate bolts (not shown).

Figure 4A:
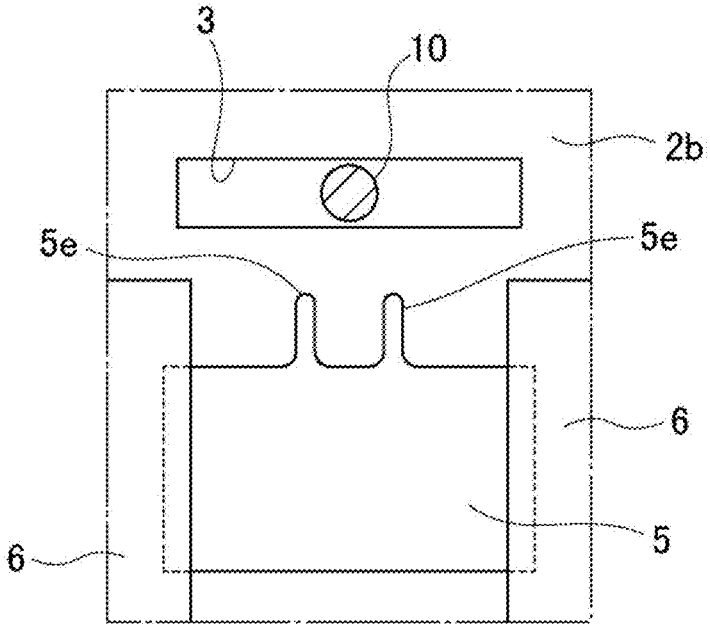
FIG. 4A is a schematic view of a regulating plate portion when it advances.
Figure 4B:
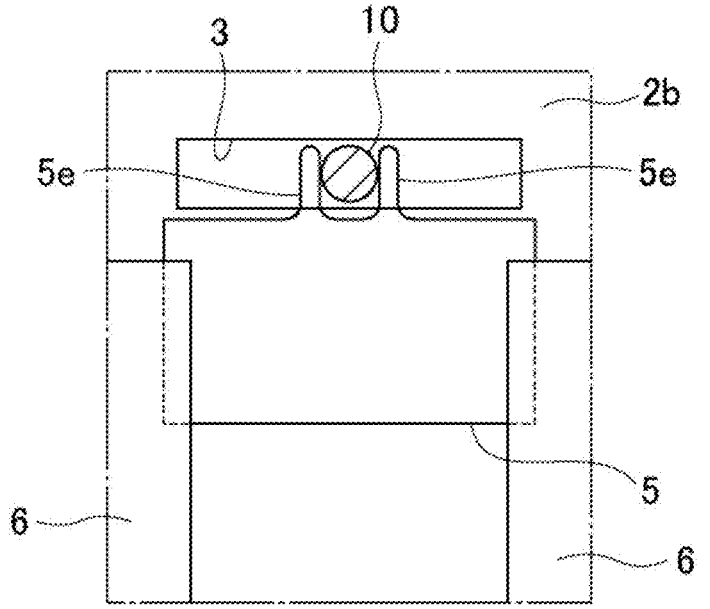
FIG. 4B is a schematic view of the regulating plate portion when it retreats.
Figure 5A:
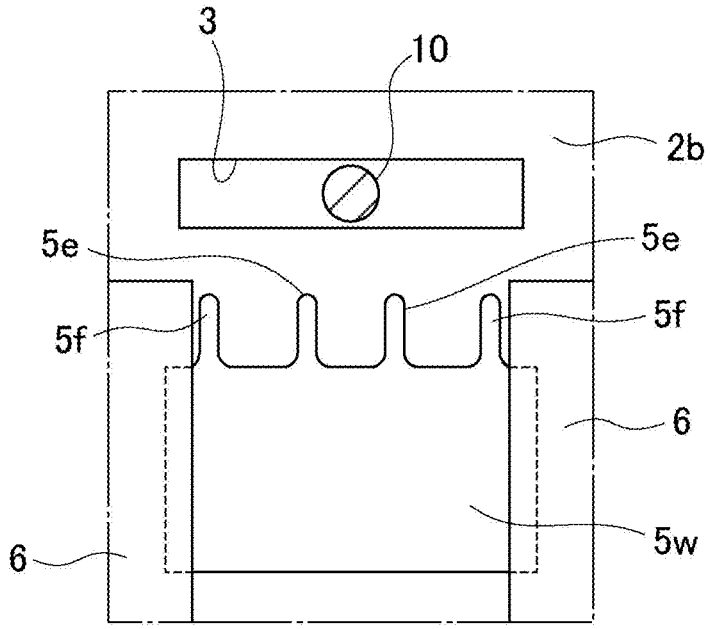
FIG. 5A is a schematic view of another regulating plate portion when it advances.
Figure 5B:
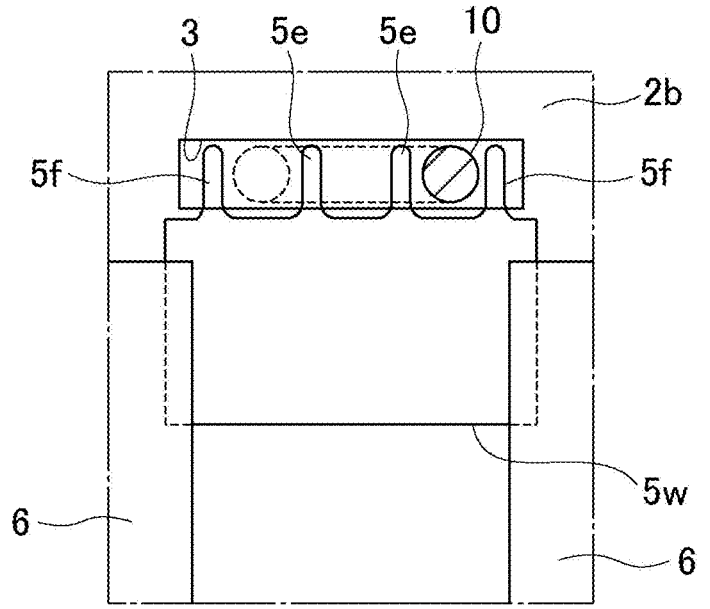
FIG. 5B is a schematic view of the other regulating plate portion when it retreats.

The schematic views of FIGS. 5A and 5B each show a regulating plate portion 5*w* that is another example of the regulating plate portion 5 of FIGS. 4A and 4B. In a regulating plate portion 5*w* of FIGS. 5A and 5B, claw portions 5*f* are further provided on the left and right sides of the two claw portions 5*e* (see FIG. 5A). In the regulating plate portion 5 of FIGS. 4A and 4B, the position of the grip shaft portion 10 is regulated at the central portion in a longitudinal direction of the shaft opening portion 3 due to the position of the two claw portions 5*e*. On the other hand, in the regulating plate portion 5*w* of FIGS. 5A and 5B, the claw portions 5*f* are also added to the claw portions 5*e*, and thus the grip shaft portion 10 is sandwiched between the claw portion 5*e* and the claw portion 5*f*, and the position of the grip shaft portion 10 can be regulated at the end of the shaft opening portion 3 (see FIG. 5B). Therefore, when the regulating plate portion 5*w* is employed, the grip shaft portion 10 is regulated at a position corresponding to the user's movement, training content and the like.

Figure 6:
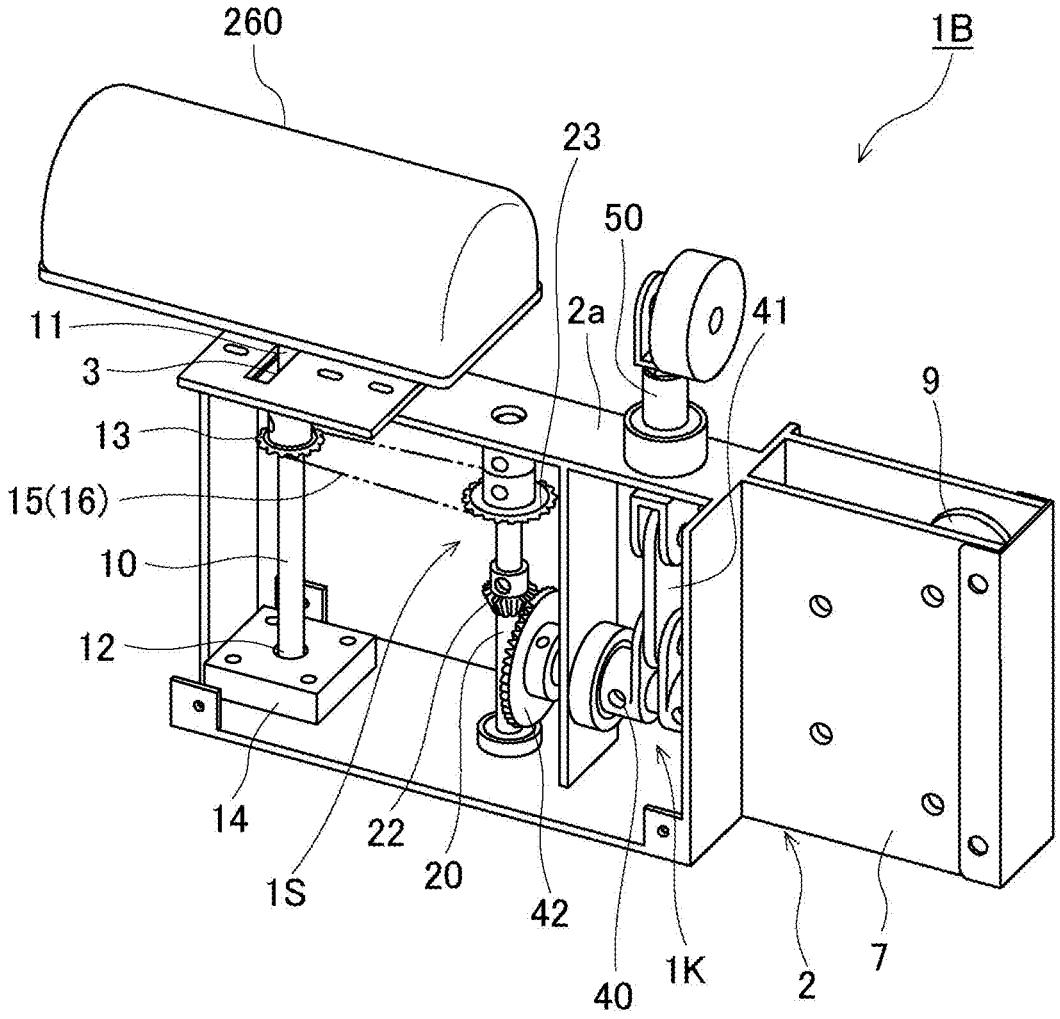
FIG. 6 is a side perspective view showing a load transmission mechanism unit for training device according to a second example.
Figure 7:
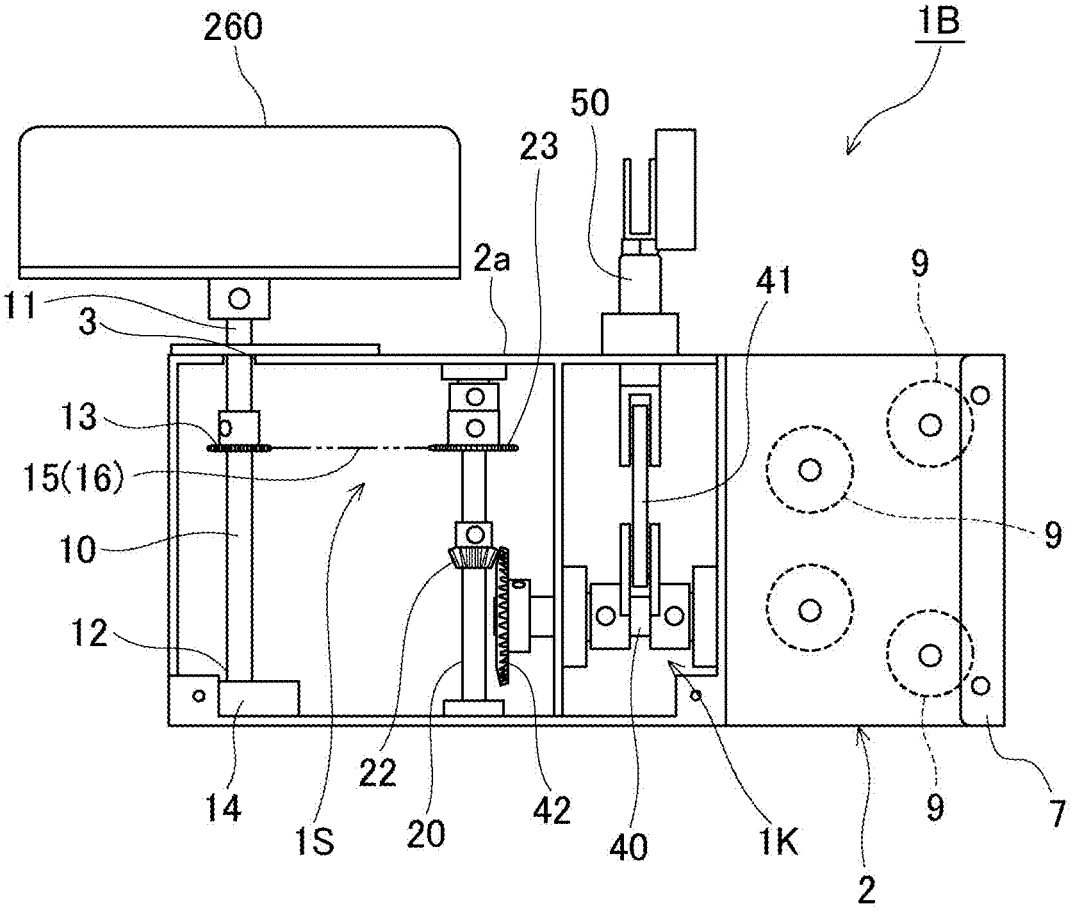
FIG. 7 is a side view of FIG. 6.

Load Transmission Mechanism Unit for a Training Device According to a Second Example FIGS. 6 and 7 are a perspective view and a side view showing an internal structure of a load transmission mechanism unit 1B for training device according to a second example. The load transmission mechanism unit 1B for training device is mainly intended to be connected to training device 200 (see FIG. 16), which will be described below. The constituent elements common to those in FIGS. 1 and 2 are designated by the same reference signs, and description thereof will be omitted.

In the load transmission mechanism unit 1B for training device, the mechanism and the device configurations of the rotation transmission unit 1S and the crank mechanism unit 1K are the same as those of the load transmission mechanism unit 1A for training device described above. However, the positions of the first end portion 11 and second end portion 12 of the grip shaft portion 10 are upside down. Further, the swing holding plate portion 14 for swinging the grip shaft portion 10 on the shaft opening portion 3 is also provided. The regulating plate portion 5 described above (see FIGS. 4A and 4B) can also be installed in the load transmission mechanism unit 1B for training device, and the regulating plate portion 5 can prevent the swing of the grip shaft portion 10 at the shaft opening portion 3.

Figure 16:
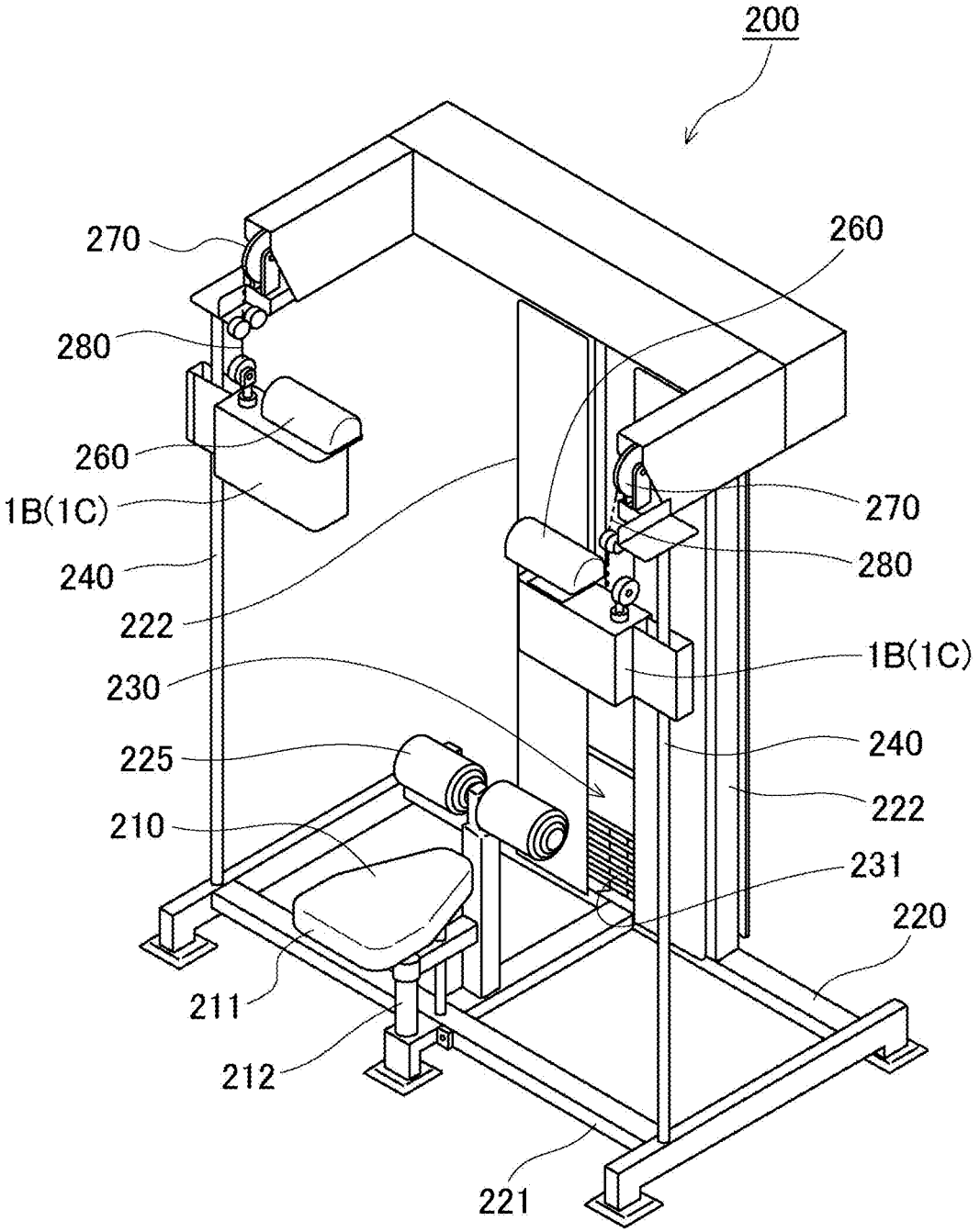
FIG. 16 is a perspective view of second training device.
Figure 17:
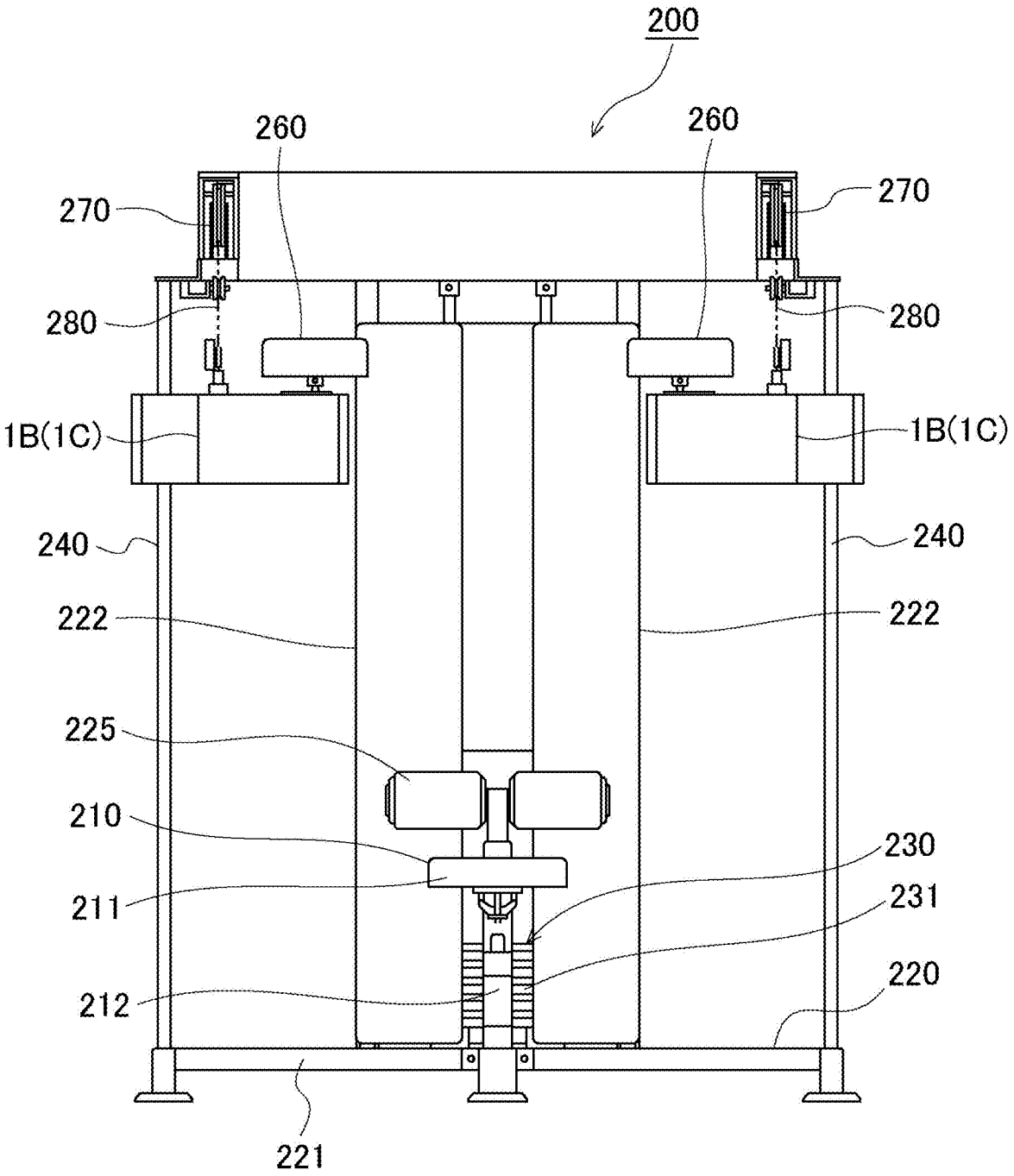
FIG. 17 is a front view of the second training device.

The load transmission mechanism unit 1B for training device includes a connection portion 7 for connection to the training device 200 (see FIG. 16). The connection portion 7 of the illustrated load transmission mechanism unit 1B for training device is constituted by a plurality of rollers 9. A guide column 240 of the training device 200 is held between the plurality of rollers 9, and the load transmission mechanism unit 1B for training device can move up and down and turn.

A grip portion 260 connected to the grip shaft portion 10 of the load transmission mechanism unit 1B for training device is a semi-cylindrical object, and the user places the palm of the hand on a curved portion of the grip portion 260 and grips the grip portion 260 with the fingers. Depending on the content of the training, the user adjusts the direction in which the grip portion 260 is connected to the grip shaft portion 10 and the angle at which the grip portion 260 is connected to the grip shaft portion 10 as appropriate. Furthermore, the direction of the fingertips when gripping the grip portion 260 is arbitrary.

Figure 8:
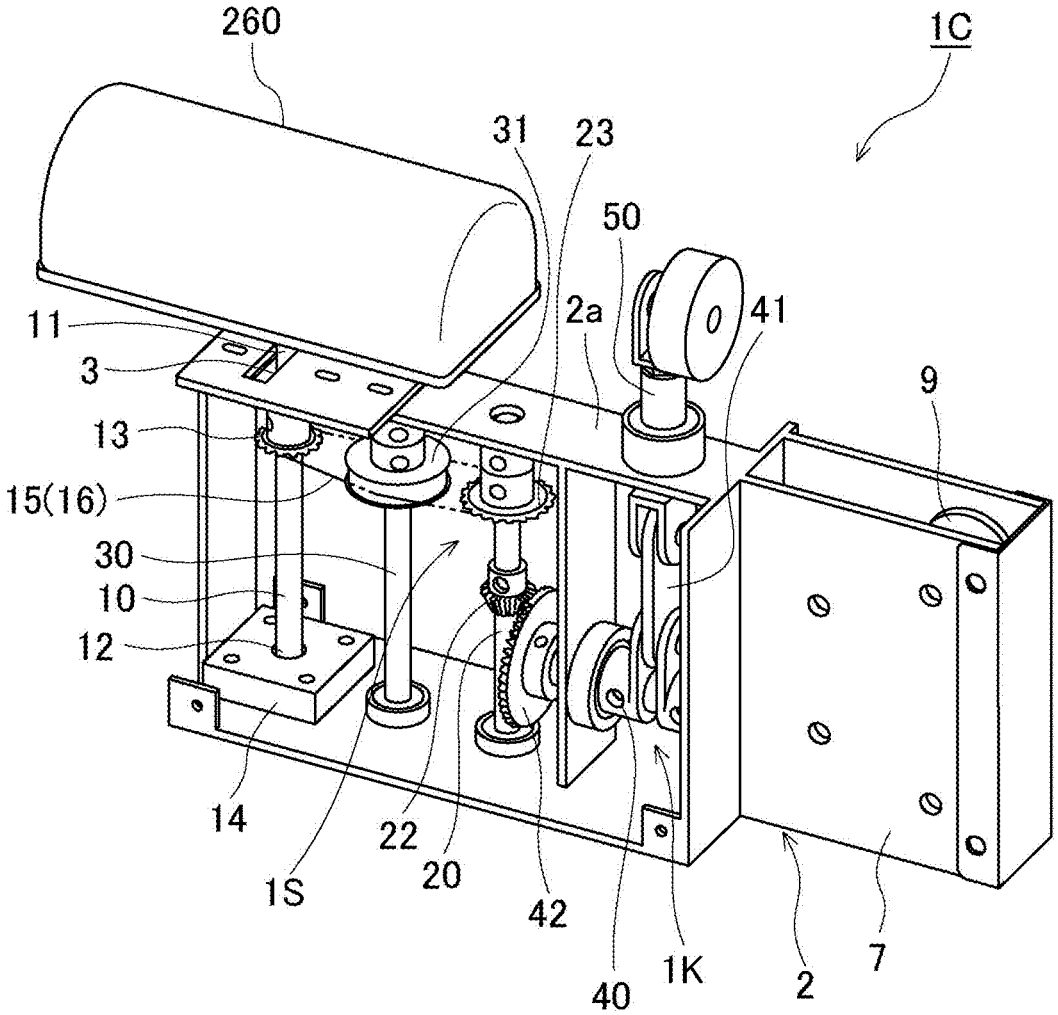
FIG. 8 is a side perspective view showing a load transmission mechanism unit for training device according to a third example.
Figure 9:
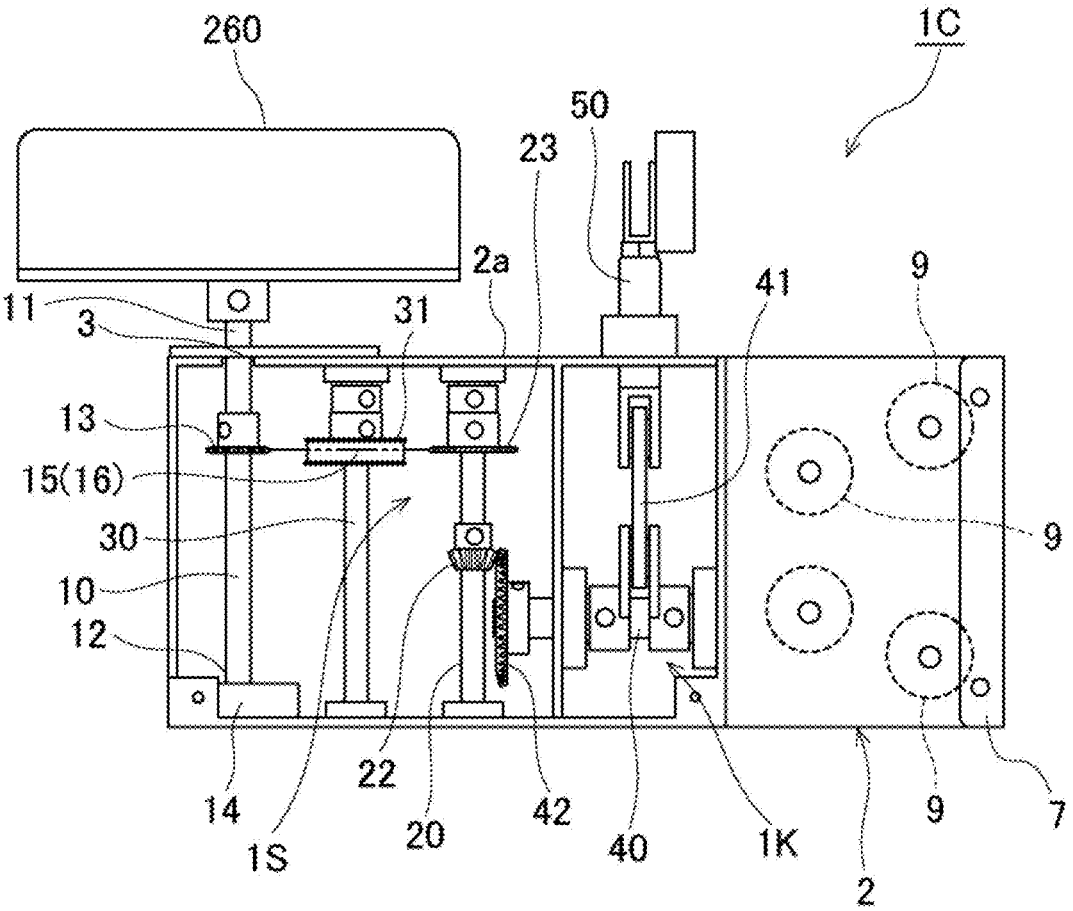
FIG. 9 is a side view of FIG. 8.

Load Transmission Mechanism Unit for a Training Device According to a Third Example FIGS. 8 and 9 are a perspective view and a side view showing an internal structure of a load transmission mechanism unit 1C for training device according to a third example. The load transmission mechanism unit 1C for training device is mainly intended to be connected to the training device 200 (see FIG. 16), which will be described below. The constituent elements common to those in FIGS. 1 and 2 are designated by the same reference signs, and description thereof will be omitted.

In the load transmission mechanism unit 1C for training device, the mechanism and the device configurations of the rotation transmission unit 1S and the crank mechanism unit 1K are the same as those of the load transmission mechanism units for training device 1A and 1B described above. However, the positions of the first end portion 11 and second end portion 12 of the grip shaft portion 10 are upside down. Further, the swing holding plate portion 14 for swinging the grip shaft portion 10 on the shaft opening portion 3 is also provided. The regulating plate portion 5 described above (see FIGS. 4A and 4B) can also be installed in the load transmission mechanism unit 1C for training device, and the regulating plate portion 5 can prevent the swing of the grip shaft portion 10 at the shaft opening portion 3. Furthermore, the configuration of the connection portion 7 and the plurality of rollers 9 for connection to the training device 200 (see FIG. 16) is the same as that of the load transmission mechanism unit 1B for training device.

As a feature of the load transmission mechanism unit 1C for training device, a biasing shaft portion 30 is provided between the grip shaft portion 10 and the intermediate shaft portion 20 of the rotation transmission unit 1S. The biasing shaft portion 30 applies tension to the transmission portion 15 (the transmission chain 16) suspended between the grip shaft sprocket 13 of the grip shaft portion 10 and the intermediate shaft sprocket 23 of the intermediate shaft portion 20. Especially, in the illustrated biasing shaft portion 30, the biasing shaft portion 30 includes a disk portion 31. Therefore, the transmission portion 15 (the transmission chain 16) is pulled in accordance with the expansion of the diameter of the disk portion 31.

As is clear from the load transmission mechanism unit 1C for training device disclosed in FIGS. 8 and 9, the grip portion 260 is connected to the first end portion 11 on the upper side of the grip shaft portion 10. The grip shaft portion 10 is swingable in the shaft opening portion 3. When the grip portion 160 hangs vertically as in the load transmission mechanism unit 1A for training device, the grip shaft portion 10 is located approximately at the center of the shaft opening portion 3. If the transmission portion 15 (the transmission chain 16) is firmly suspended between the grip shaft portion 10 and the intermediate shaft portion 20, the resistance between the grip shaft portion 10 and the intermediate shaft portion 20 during rotation increases, and the wear of the transmission portion 15 (the transmission chain 16) itself increases as well. As a result, extra burden is caused on the user's movements when using the training device. For this reason, to smoothly rotate each portion including the grip shaft portion 10, the transmission portion 15 (the transmission chain 16) is appropriately loosened and is suspended between the grip shaft portion 10 and the intermediate shaft portion 20. This configuration is similarly applied to the load transmission mechanism units for training device 1A and 1B.

Since the transmission portion 15 (the transmission chain 16) is suspended loosely, the grip shaft portion 10 of the load transmission mechanism unit 1B for training device described above is susceptible to fall to either end of the shaft opening portion 3 under the influence of the own weight of the grip portion 260. In the load transmission mechanism unit 1C for training device, the diameter of the biasing shaft portion 30 (its disk portion 31) is larger than each of the diameter of the grip shaft sprocket 13 and the diameter of the intermediate shaft sprocket 23. For this reason, even if an appropriate tension is generated in the transmission portion 15 (the transmission chain 16), the meshing (the engagement) between the transmission portion 15 (the transmission chain 16), the grip shaft sprocket 13, and the intermediate shaft sprocket 23 is reduced. As a result, when the grip shaft portion 10 rotates, the resistance between the transmission portion 15 (the transmission chain 16), the grip shaft sprocket 13, and the intermediate shaft sprocket 23 is also reduced. In this way, no extra burden is caused on the user's movements when using the training device. Such a mechanism for applying tension to the transmission portion 15 (the transmission chain 16) can be similarly applied to the load transmission mechanism units for training device 1A and 1B described above.

First Training Device

The configuration of a first training device 100 is shown in FIGS. 10 to 15. The first training device 100 is device equipped with the load transmission mechanism unit 1A for training device of the first example.

As shown in FIGS. 10 to 15, the first training device 100 includes a seating portion 110, a frame 120 that supports the seating portion 110, the load applying portion 130 that is provided on the frame 120 and can adjust the magnitude of the load, two guide columns 140 that are vertically fixed to the frame 120 at a predetermined interval such that the seating portion 110 is in the center position of the frame 120, two load transmission mechanism units for training device 1A to each of which one end of each of the two guide columns 140 is fitted to be vertically movable and to be horizontally rotatable, the grip portion 160 that is connected to the first end portion 11 of the grip shaft portion 10 of each of the two load transmission mechanism units for training device 1A, and a tensioning member 180 of which one end is connected to the load applying portion 130 and the other end is wound around a direction change guide wheel 170 provided in the frame 120 and is connected to the other end side of the load transmission mechanism unit 1A for training device from the fitting position to the guide column 140, and a load is applied to the rotation about the axis of the grip portion 160 by the load applying portion 130 by connecting a member in the load transmission mechanism unit 1A for training device to the other end side of the tensioning member 180.

The seating portion 110 includes a seat 111 suitable for a user using the training device 100 to seat facing a front direction, and a seat column 112 provided vertically on the lower surface of the seat 111.

The frame 120 allows the training device 100 to be stably installed on the floor and serves as a framework of the entire training device 100, and the seating portion 110, the load applying portion 130, the two guide columns 140 and the like are fixed to the frame 120. The seat column 112 is inserted into a hole vertically extending in front of the center of the lower surface of the frame 120, and thus the seating portion 110 is supported by the frame 120. The frame 120 includes a thigh pressing portion 121 that prevents the thighs of a user seated on the seat 111 from lifting up. Preferably, the thigh pressing portion 121 is provided to allow the user to make an appropriate arch in the back during training.

The load applying portion 130 can adjust the magnitude of the load provided in the frame 120, and includes weights 131 made of a plurality of plate-shaped plates that are heavy metal members, weight guide columns 132 that support the weights 131 such that the weights 131 are vertically movable in the frame 120, and a clamp (not shown) that can connect the weights 131 to each other and separate the weights 131 from each other. By increasing or decreasing the number of weights 131, the load of the load applying portion 130 is adjusted. A pair of cylindrical weight guide columns 132 are vertically fixed to the frame 120 at the rear of the seating portion 110 with their upper and lower ends spaced apart from each other by a predetermined lateral distance, and the plate-shaped plates of the weights 131 are stacked with their through holes inserted by the weight guide columns 132 and are supported in the frame 120 to be vertically movable.

The two load transmission mechanism units for training device 1A are fitted to the two guide columns 140 via the connection portions 7 to be vertically movable and horizontally rotatable. The grip portion 160 connected to the grip shaft portion 10 of the load transmission mechanism unit 1A for training device is a handle of an annular object that is gripped by the user's hand. Each grip portion 160 can rotate about its axis in the horizontal direction with respect to the load transmission mechanism unit 1A for training device. Further, the grip shaft portion 10 is also swingable. In the initial state (see FIGS. 10 and 11), each grip portion 160 is in a position where the back of the hand of the user who grips each grip portion 160 faces the outside of the training device 100. In the initial state, each grip portion 160 is located further above the position of the hand of the user seated on the seat 111 who extends his arm upward. Then, the user can lower the load transmission mechanism unit 1A for training device through the grip portion 160. At this time, the user can open both arms from the midline to the outside at the chest (see FIGS. 12 and 13).

The tensioning member 180 is a rope or wire of the same length, and one end of the tensioning member 180 is connected to the weights 131. The tensioning member 180 of which one end is fixed to the weights 131 is wound around the direction change guide wheel 170. The direction change guide wheel 170 changes a downward load applied to the tensioning member 180 by the weights 131 into an upward load.

Figure 11:
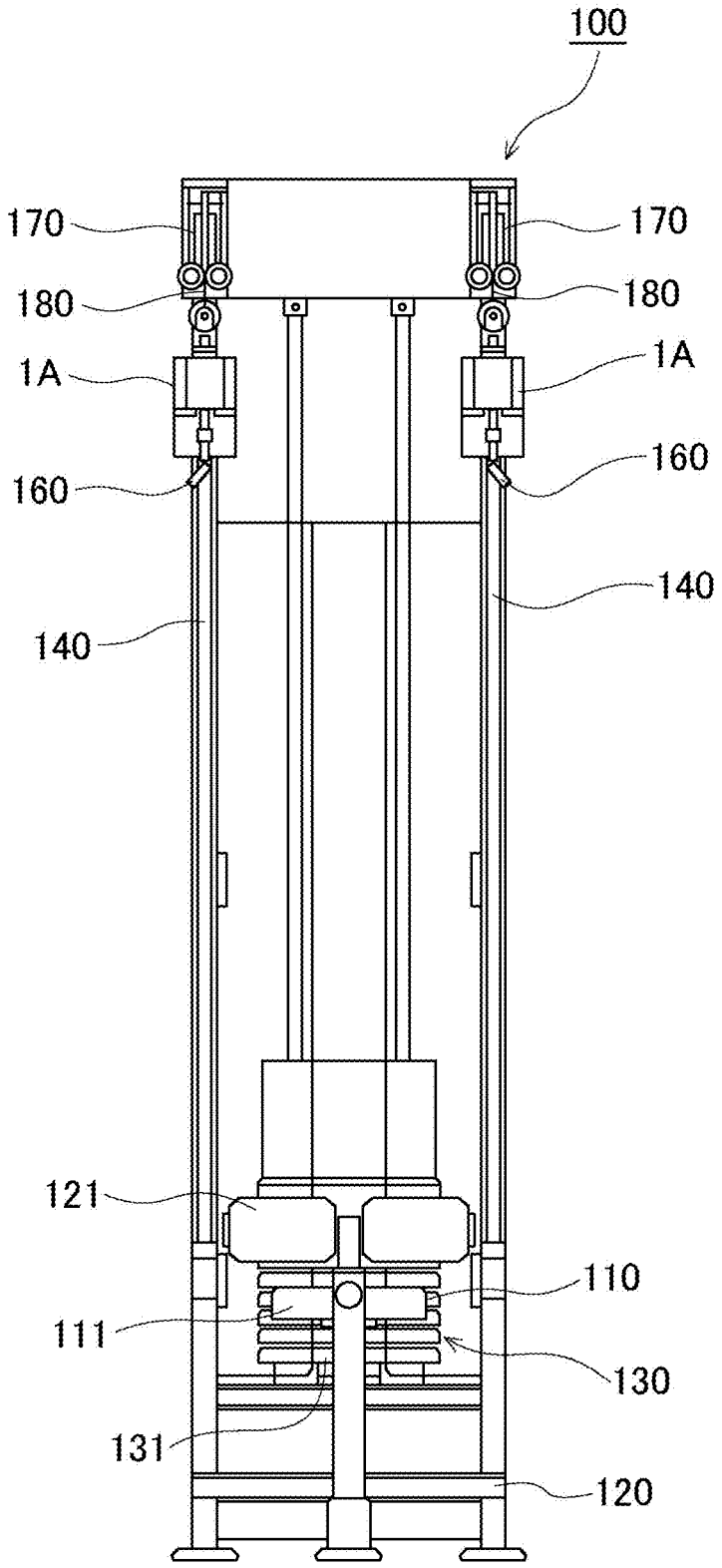
FIG. 11 is a front view of the first training device.
Figure 12:
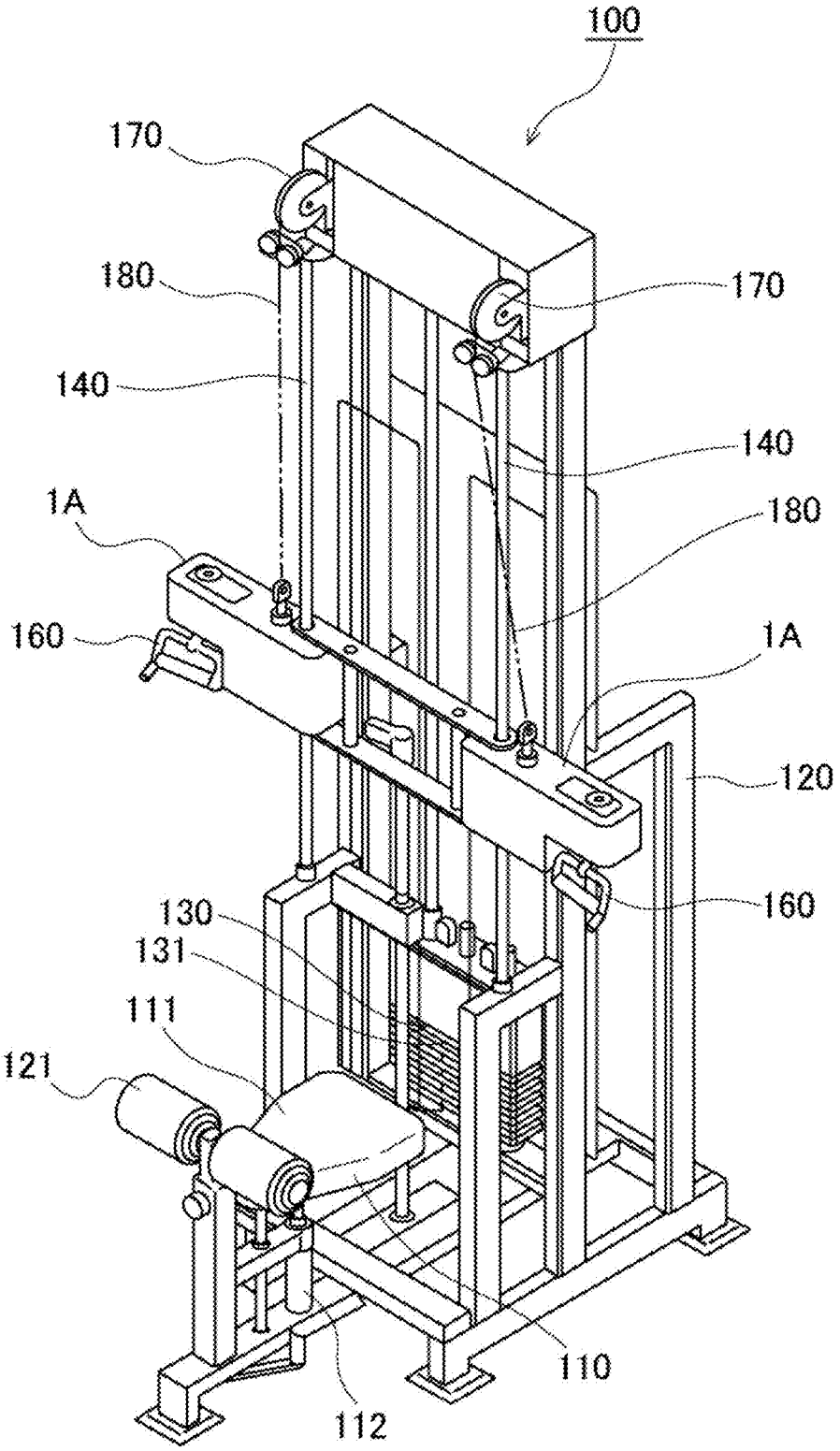
FIG. 12 is a perspective view of a first usage mode of the first training device.
Figure 13:
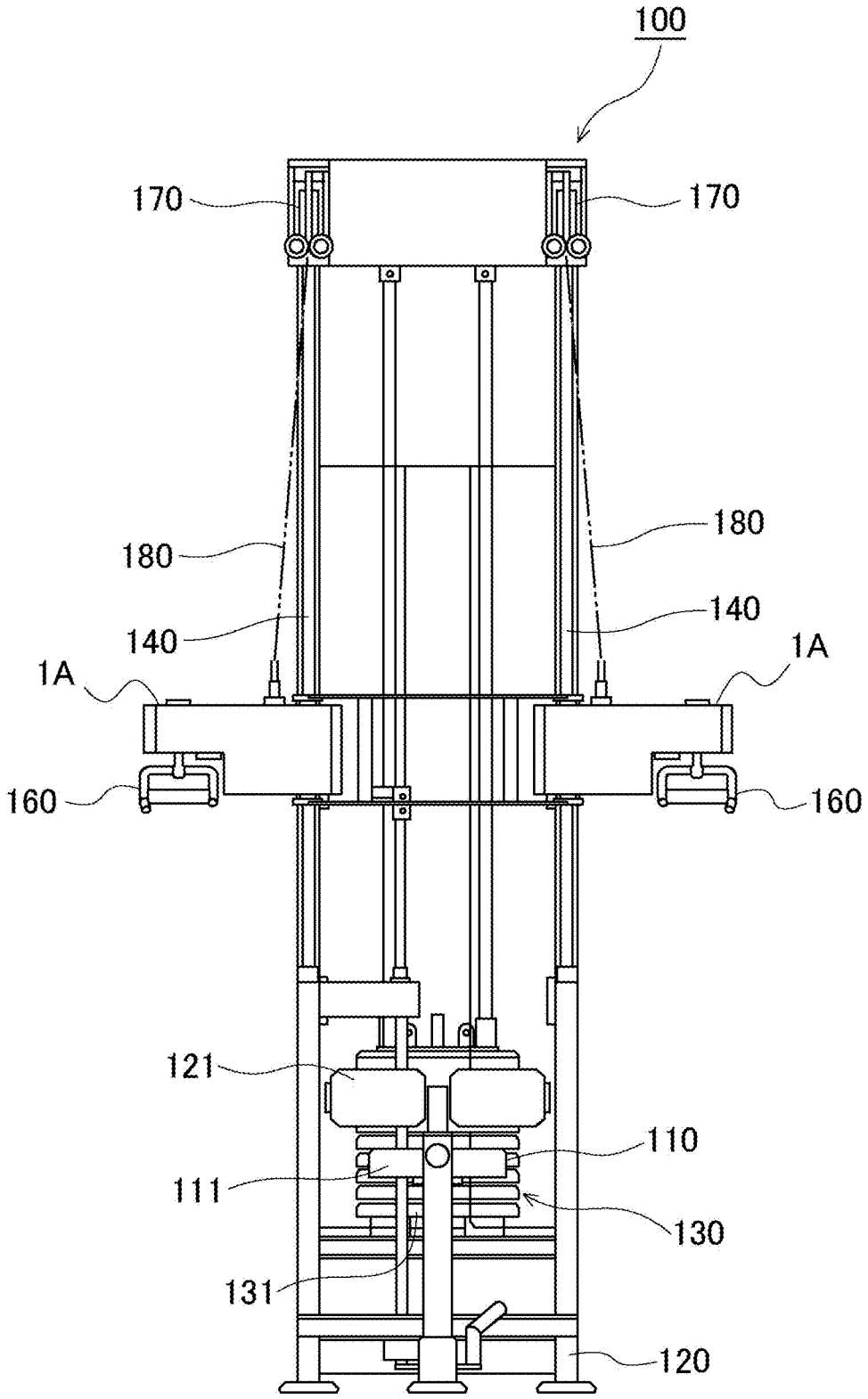
FIG. 13 is a front view of the first usage mode of the first training device.

In the initial state shown in FIGS. 10 and 11, rotation of the load transmission mechanism unit 1A for training device is regulated. On the other hand, in the states shown in FIGS. 12 and 13, the user can rotate the load transmission mechanism unit 1A for training device up to a predetermined angle against the force for rotationally biasing the load transmission mechanism unit 1A for training device to face the front direction. The force for rotationally biasing the load transmission mechanism unit 1A for training device to face the front direction is proportional to the load of the load applying portion 130 and approximately inversely proportional to the vertical position of the load transmission mechanism unit 1A for training device.

Figure 14:
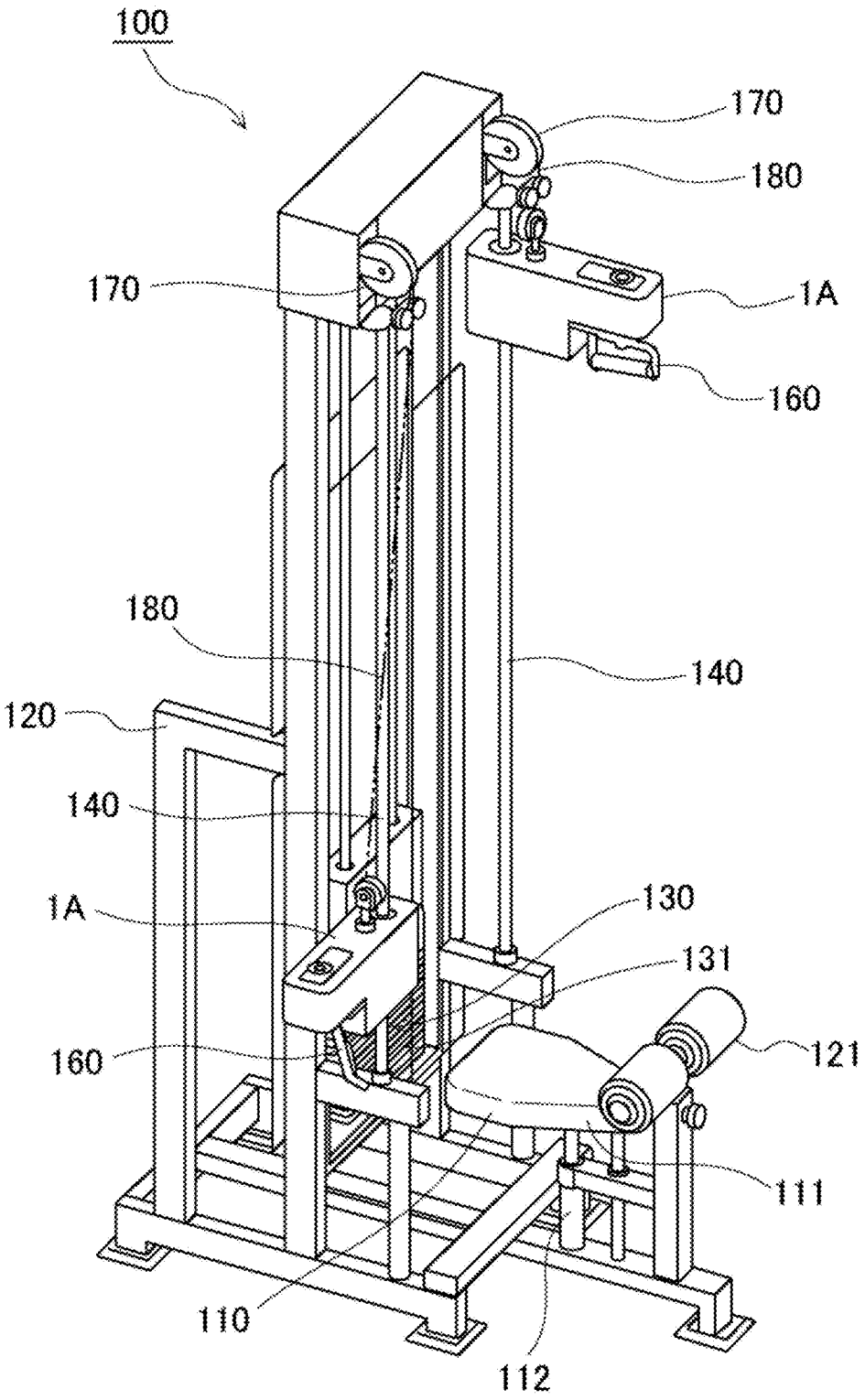
FIG. 14 is a perspective view of a second usage mode of the first training device.
Figure 15:
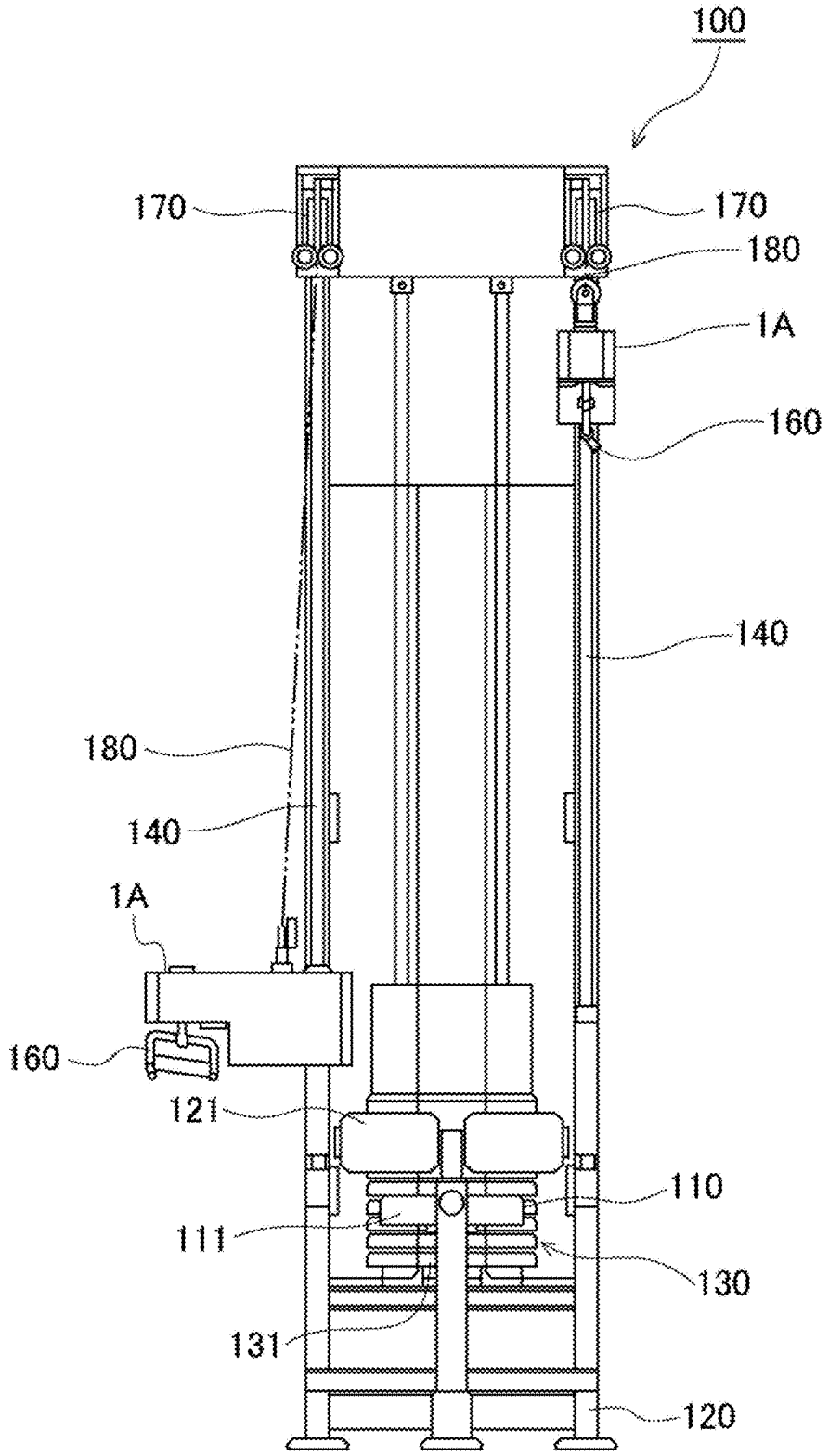
FIG. 15 is a front view of the second usage mode of the first training device.

As shown in FIGS. 14 and 15, it is also possible to perform training on the training device 100 with different lifting and lowering movements of the left and right load transmission mechanism units for training device 1A.

Usage Method for First Training Device

A typical usage method for the training device 100 will be explained sequentially. First, the weights 131 are disposed according to the load taking into account the user's muscle strength, purpose and the like. The user seats on the seat 111 facing forward, adjusts the seat 111 to an appropriate height such that the soles of the user's feet are in contact with the floor, and fixes the seat 111. Furthermore, the thigh pressing portion 121 is adjusted to an appropriate height to such an extent that the thigh pressing portion 121 comes into contact with the upper surface of the thigh of the user seated on the seat 111 and is fixed.

Next, the user stands up and grips each of the grip portions 160 with the backs of the hands facing the left and right sides of the training device 100, in accordance with the initial state of the load transmission mechanism unit 1A for training device facing the front direction (see FIGS. 10 and 11). Then, while gripping the grip portion 160 with the hand extended upward and pulling the grip portion 160 downward, the user seats on the seat 111 facing the front direction.

Next, the user twists both upper arms outward against the rotational biasing force acting on the grip portion 160 by a force proportional to the load of the load applying portion 130, rotates each grip portion 160 about its axis in the horizontal direction with respect to the load transmission mechanism unit 1A for training device, and thus causes the back of the hand gripping each grip portion 160 to face the front direction of the training device 100. By taking this "dodging movement" position, the flexor muscle and the extensor muscle are "relaxed" together, and the shoulder and the arms become a relaxed state. Furthermore, the grip portion 160 is biased upward by the load of the load applying portion 130, and the muscles in the vicinity of the shoulder girdle and the like are appropriately "stretched."

Next, the user pulls down the grip portions 160 by flexing the both arms and "shortening" the muscles against the load of the load applying portion 130 such that the appropriately "stretched" muscles in the vicinity of the shoulder girdle and the like cause a "reflex." At this time, the grip portions 160 are pulled down with both hands while further adding "relaxation" and "stretching" movements of twisting the upper arms outward. This movement of twisting the upper arms outward causes each grip portion 160 to further rotate about its axis in an outward horizontal direction with respect to the load transmission mechanism unit 1A for training device, and thus the weights 131 are pulled up, and the load in the initial movement of pulling down the both arms is reduced. In this way, when the muscles are "shortened" by flexing the both arms and pulling down the grip portions 160, by further twisting the upper arms outward, the appropriate "shortening" timing can be made to appear while adding the "relaxation" and "extension" movements, and thus each muscle group can obtain the "relaxation-stretching-shortening" timing and perform the movements in good coordination.

When the user flexes the both arms and pulls down the grip portion 160, the user gradually spreads the both arms outward against the force for rotationally biasing the load transmission mechanism unit 1A for training device to face the front direction such that each load transmission mechanism unit 1A for training device faces outward. Since the force for rotationally biasing the load transmission mechanism unit 1A for training device to face the front direction is approximately inversely proportional to the position (the height) of the load transmission mechanism unit 1A for training device, the resistance against the outward spreading of the both arms is reduced as the user flexes the both arms and pulls down the grip portions 160. For this reason, when flexing the both arms and pulling down the grip portion 160, the user can smoothly perform the movement of gradually spreading the both arms outward while pulling down the grip portions 160 by outputting a substantially constant amount of a muscle force to spread the both arms outward, and thus it is possible to prevent co-contraction of the muscles.

Next, the user pulls down each grip portion 160 to approximately the height of the shoulder and then extends the both arms while twisting the upper arms inward and closing the both arms inward according to the each biasing force due to the load of the load applying portion 130, and thus slowly returns the back of the hand to the seated state in accordance with the grip portion 160. As a result, one cycle of the training is completed. Then, this training is repeated for the appropriate number of cycles.

Second Training Device

The configuration of a second training device 200 is shown in FIGS. 16 to 19. The second training device 200 is device equipped with the load transmission mechanism unit 1B for training device of the second example or the load transmission mechanism unit 1C for training device of the second example.

As shown in FIGS. 16 to 19, the second training device 200 includes a seating portion 210, a frame 220 that supports the seating portion 210, a load applying portion 230 that is provided on the frame 220 and can adjust the magnitude of the load, two left and right guide columns 240 that vertically extend in the frame 220 at a predetermined interval in the left-right direction such that the seating portion 210 is in the center position of the frame 220, two load transmission mechanism units for training device 1B (1C) which are guided by the left and right guide columns 240 and are movable in the vertical direction, the grip portion 260 that is connected to the grip shaft portion 10 provided in each of the two load transmission mechanism unit 1B for training device (1C) and can be rotated, and a tensioning member 280 of which one end is connected to the load applying portion 230 and the other end is wound around a direction change guide wheel 270 provided in the frame 220 and is connected to the load transmission mechanism unit 1B for training device (1C), and a load is applied to the rotation about the axis of the grip portion 260 by the load applying portion 230 by connecting a member in the load transmission mechanism unit 1B for training device (1C) to the other end of the tensioning member 280.

The seating portion 210 includes a seat 211 suitable for a user using the training device 200 to seat facing a rear direction (a side of the load applying portion 230), and a seat column 212 provided vertically on the lower surface of the seat 211.

The frame 220 includes a lower frame 221 of which at least four corners are placed on the floor, two vertical columns 222 vertically fixed from the rear of the lower frame 221 at a predetermined left-right interval, and an upper frame 223 supported by and fixed to the two vertical columns 222. The frame 220 includes the seating portion 210, the load applying portion 230, the left and right guide columns 240, the direction change guide wheel 270 and the like. The frame 220 supports a thigh pressing portion 225 that prevents the thighs of a user seated on the seat 211 from lifting up. This thigh pressing portion 225 is provided to allow the user to make an appropriate arch in the back during training.

The load applying portion 230 can adjust the magnitude of the load provided in the frame 220, and includes weights 231 made of a plurality of plate-shaped plates that are heavy metal members, weight guide columns 232 that support the weights 231 such that the weights 231 are vertically movable in the frame 220, and a clamp (not shown) that can connect the weights 231 to each other and separate the weights 231 from each other. By increasing or decreasing the number of weights 231, the load of the load applying portion 230 is adjusted. A pair of cylindrical weight guide columns 232 vertically extend at a predetermined interval in the left-right direction between the two vertical columns 222, and have an upper end and a lower end fixed to the lower frame 221 and the upper frame 223, respectively. Each of the plate-like plates of the weights 231 is stacked with through holes on the both sides thereof inserted by the weight guide column 232, and is supported by the weight guide column 232 to be vertically movable.

The two load transmission mechanism units for training device 1B (1C) are provided on the two guide columns 240 via the connection portions 7 (the roller 9 thereof) to be vertically movable and horizontally rotatable. The two load transmission mechanism units for training device 1B (1C) each include the grip portion 260 of a semi-cylindrical object that the user grips and presses down with the palm of the hand. The grip portion 260 can rotate about its axis in the horizontal direction with respect to the load transmission mechanism unit 1B for training device (1C). Further, the grip portion 260 is swingable by the grip shaft portion 10. In the initial state (see FIGS. 16 and 17), each grip portion 260 is located parallel to the load transmission mechanism unit 1B for training device (1C). In the initial state, each grip portion 260 is located above the shoulder of the user seated on the seat 211 together with the load transmission mechanism unit 1B for training device (1C) due to the action of the load applying portion 230. In a state in which the user lowers the grip portion 260 to the lowest position against the action of the load applying portion 230, each grip portion 260 can be located near or below the waist of the user seated on the seat 211.

The tensioning member 280 is a rope or wire of the same length, and one end of the tensioning member 280 is connected to the weights 231. The tensioning member 280 of which one end is fixed to the weights 231 is wound around the direction change guide wheel 270. The direction change guide wheel 270 changes a downward load applied to the tensioning member 280 by the weights 231 into an upward load.

Usage Method for Second Training Device

A typical usage method for the training device 200 will be explained sequentially. First, the weights 231 are disposed according to the load taking into account the user's muscle strength, purpose and the like. The user seats on the seat 211 facing a side of the weights 231, adjusts the seat 211 to an appropriate height such that the soles of the user's feet are in contact with the floor, and fixes the seat 211. Furthermore, the thigh pressing portion 225 is adjusted to an appropriate height to such an extent that the thigh pressing portion 225 comes into contact with the upper surface of the thigh of the user seated on the seat 211 and is fixed.

Next, the user stands up, grips and presses the mutually facing sides of the grip portions 260 from above with the palm of the hand, pushes down the load transmission mechanism unit 1B for training device (1C) together with the grip portion 260, and is seated on the seat 211. At this time, the user lifts up the shoulder, bends the elbows, pulls the forearms slightly inward, and bends the wrists forward from the forearms.

Figure 18:
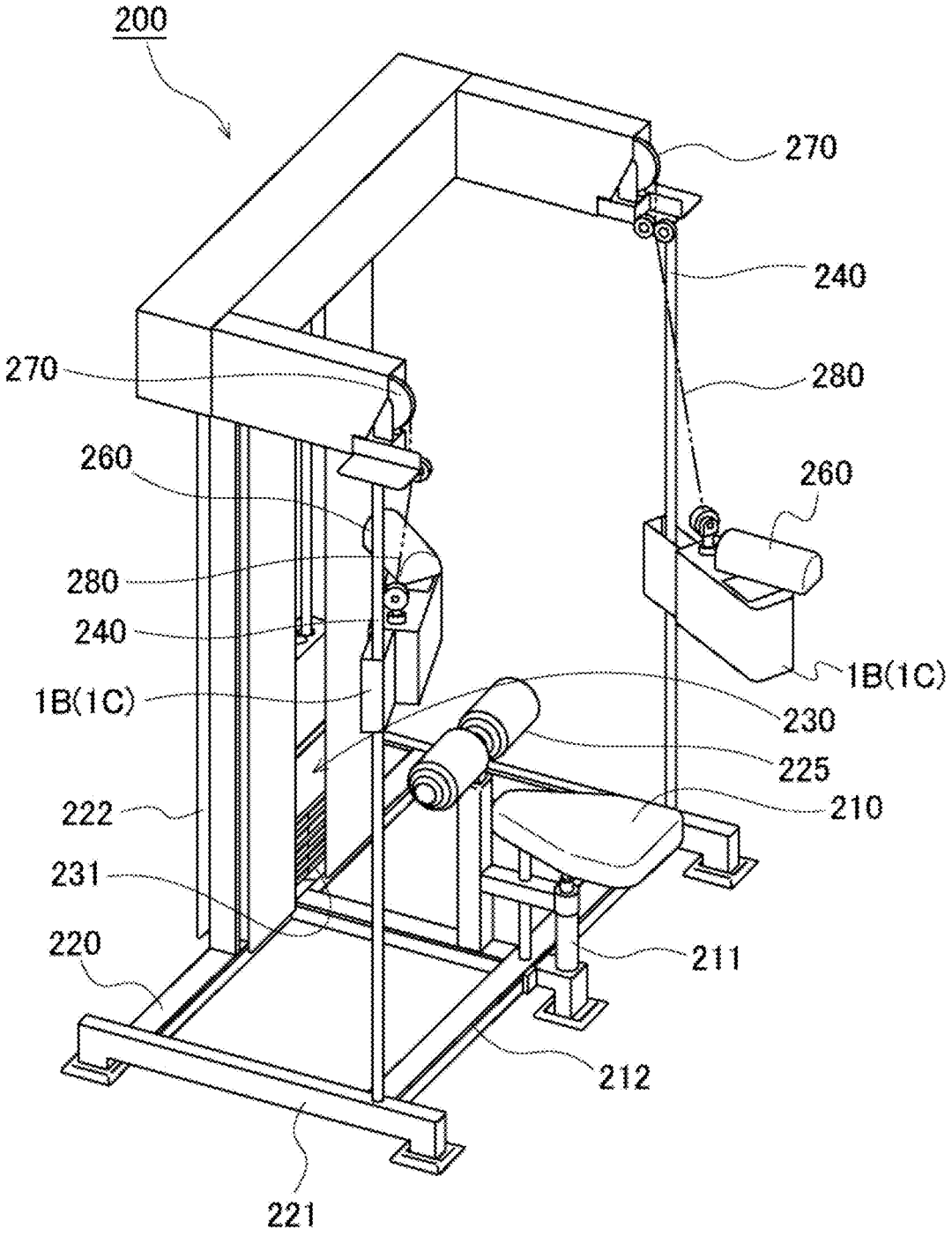
FIG. 18 is a perspective view of a usage mode of the second training device.
Figure 19:
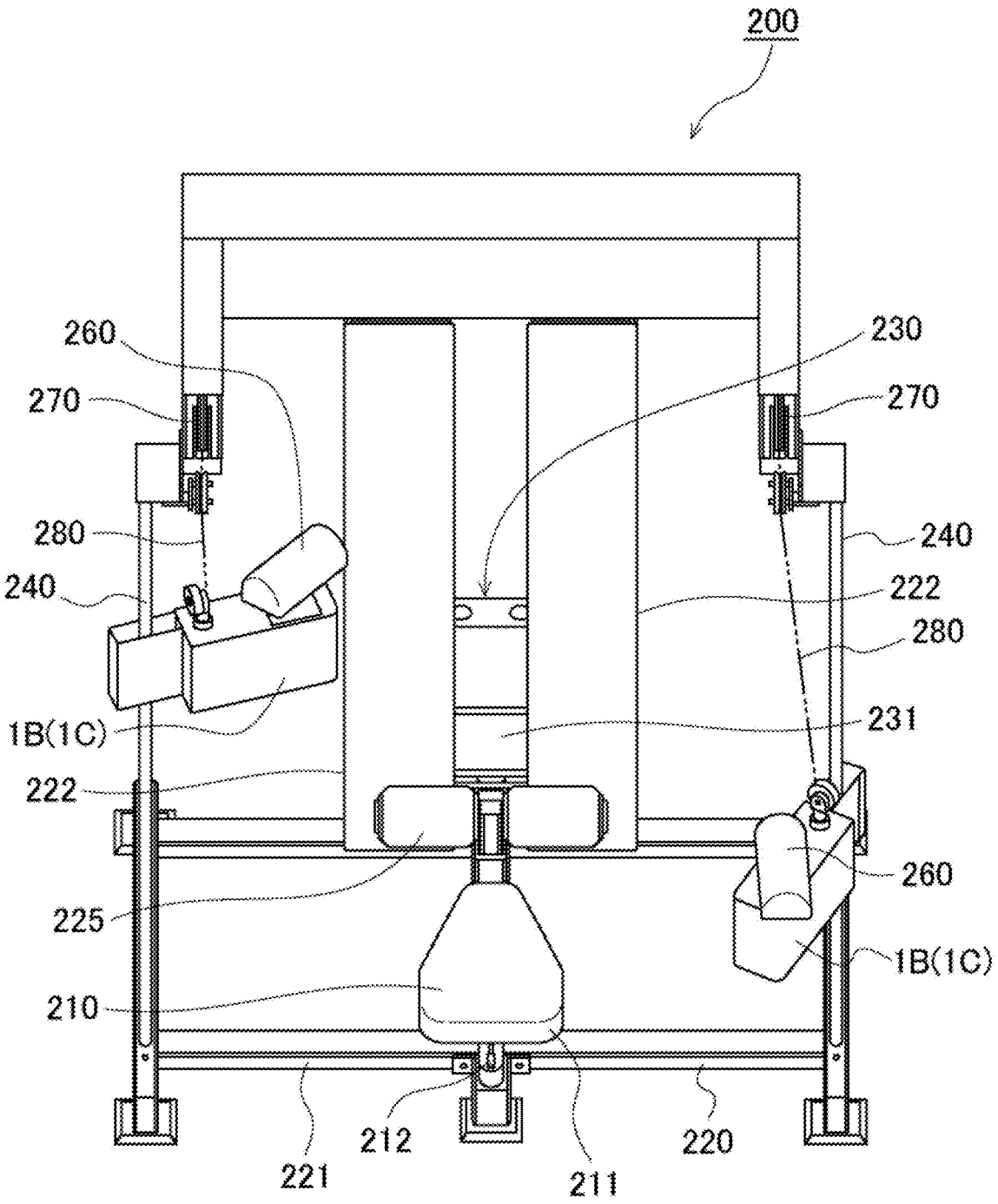
FIG. 19 is a front perspective view of a usage mode of the second training device.
Figure 20A:
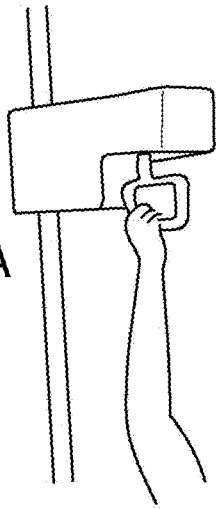
FIG. 20A is a first photograph.
Figure 20B:
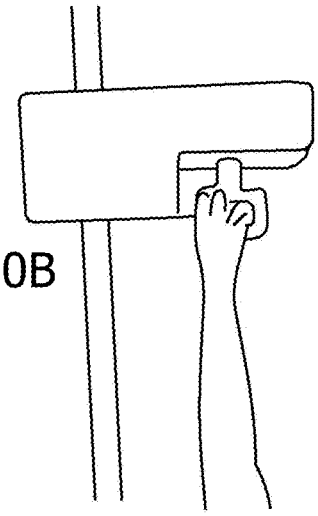
FIG. 20B is a second photograph.
Figure 20C:
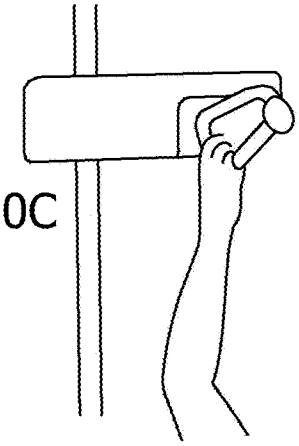
FIG. 20C is a third photograph.
Figure 20D:
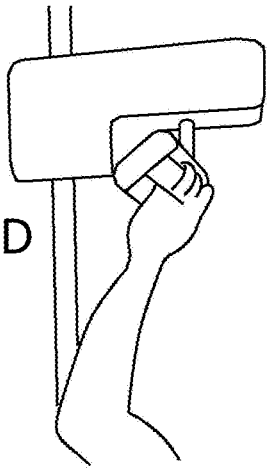
FIG. 20D is a fourth photograph.
Figure 20E:
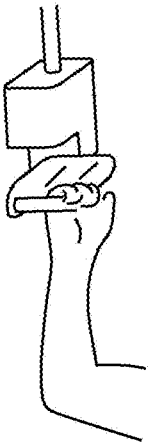
FIG. 20E is a fifth photograph of the first training device that includes the load transmission mechanism unit for training device of the first example in use.
Figure 21A:
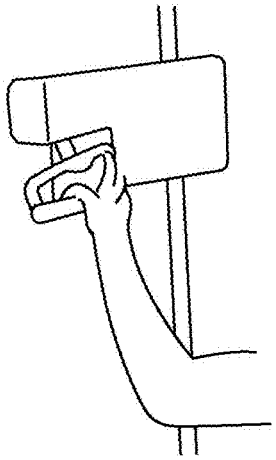
FIG. 21A is a sixth photograph.
Figure 21B:
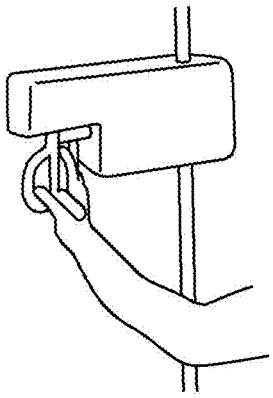
FIG. 21B is a seventh photograph.
Figure 21C:
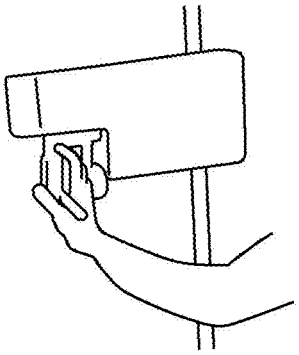
FIG. 21C is an eighth photograph.
Figure 21D:
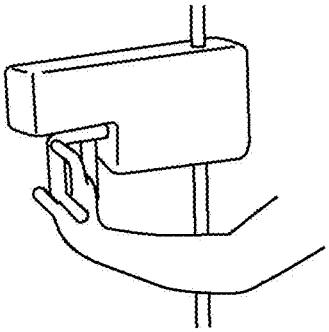
FIG. 21D is a ninth photograph.
Figure 21E:
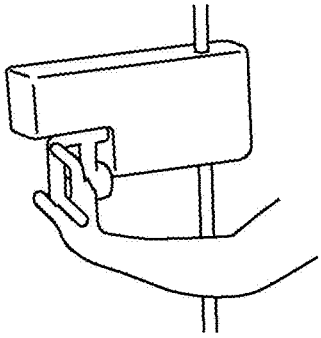
FIG. 21E is a tenth photograph of the first training device that includes the load transmission mechanism unit for training device of the first example in use.

Next, while maintaining the height position of the grip portion 260, the user twists the wrists inward against the rotational biasing force proportional to the load of the load applying portion 230, rotates the grip portion 260 about its axis with respect to the load transmission mechanism unit 1B for training device (1C), and moves the hand gripping the grip portion 260 inward and outward from the front direction, respectively (see FIGS. 18 and 19).

When the user takes this "dodging movement" position as shown in FIGS. 18 and 19, the flexor muscle and the extensor muscle are "relaxed" together, and the shoulder, the arms, and the back become a relaxed state. Furthermore, since the grip portion 260 is also biased upward by the load of the load applying portion 230, and the back muscles such as the latissimus muscles are appropriately "stretched." Since the user rotates the grip portion 260 about its axis, the user can rotate the grip portion 260 about its axis with less force against the rotational biasing force.

Next, the user moves the load transmission mechanism unit 1B for training device (1C) to a position (not shown) opposite to the position shown in FIGS. 18 and 19, and thus the both arms are extended against the load of the load applying portion 230 and the muscles are "shortened" such that the appropriately "stretched" back muscles cause the "reflex," and the user performs the pushing down of the grip portion 260 and the release thereof while adding the "relaxation" and "stretching" movements of twisting the wrists outward to the above movement. This movement of twisting the wrists outward causes the grip portion 260 to rotate about its axis in the opposite direction with respect to the load transmission mechanism unit 1B for training device (1C), and thus the load in the initial movement of the pushing down is reduced. In this way, when the muscles are "shortened" by pushing down the grip portion 260, by further twisting the wrists outward, the appropriate "shortening" timing can be made to appear while adding the "relaxation" and "extension" movements, and thus each muscle group can obtain the "relaxation-stretching-shortening" timing and perform the movements in good coordination. Further, when the user extends the both arms and pushes down the grip portion 260, the load transmission mechanism unit 1B for training device (1C) is guided by the guide column 240 and moves vertically downward together with the grip portion 260, and thus the user can extend the both arms and push down the grip portion 260 smoothly, and it is possible to prevent co-contraction of the muscles.

The user pushes down the grip portion 260 to the height of the waist and then twists the upper arms inward and bends the elbows according to the upward biasing force due to the load of the load applying portion 230 while gripping and pressing down the grip portion 260 with the palm of the hand, and thus slowly returns a state to the seated state. As a result, one cycle of the training is completed. Then, this training is repeated for the appropriate number of cycles. FIGS. 21A to 21E and 22 disclose an example in which the lifting and lowering of the load transmission mechanism unit 1B for training device (1C) is alternated on the left and right sides. Apart from this, it is also possible to perform the lifting and lowering of the left and right sides at the same time.

Outline of Training Device

The above-mentioned training device 100 and 200 is device that appropriately train the muscles of the shoulders, the arms, the back and the like through initial load training (a registered trademark). The initial load training is defined as "training performed to promote a series of movement processes of the relaxation, the stretching, and the shortening of the agonist muscles and to prevent the co-contraction of the antagonist muscles thereof and the muscles that act antagonistically using the body' change to a position where the reflex occurs and the accompanying change in center of gravity position." The initial load training is a completely different type of training from final load training, in which the load is applied until the end, causing muscle tension (hardening) and increasing the size of the muscles. In the initial load training, it is necessary to train with an understanding of the image of the movement as a whole such as the point at which the load is applied, the point and the angle at which the load is released, the rhythm, and the continuity of muscle output. The load training of the related art involves the problem that it is difficult to take proper movements and form due to body balance, partial hardening and the like. However, the training device 100 or 200 that embodies the initial load training can easily induce training with an ideal series of movements and form.

The initial load training using the training device 100 and 200 induces "intersegmental force transmission from the center (the body root and trunk portion) to the distal end portion," that is, the exertion of the force when the muscles are shortened in which the muscles are appropriately stretched or passively stretched by applying an appropriate load to the muscle spindles and tendon organs which are sensory receptors in a state where the muscles of human body which have the characteristics of contracting without trying to extend are relaxed, and at this time, by gradually decreasing the load with the continuity, it is possible to obtain an active state in which other muscles of the human, which have been said to have only the myocardium that does not cause the co-contraction, do not cause the co-contraction like the myocardium, and thus it is possible to promote and develop neuromuscular control.

Initial load training using training device 100 and 200 is training in which the load of the training device is used to cause a reflex in the muscles, and thus the muscles that should be naturally working works well and the function of the muscles and the nerves is enhanced. The load is used as a catalyst to promote the relaxed muscles to stretch and shorten in a timely manner This kind of training promotes a series of movements of the relaxation, the stretching, and the shortening and prevents the co-contraction, and thus the function and coordination of the nerves and the muscles are enhanced, the burden on the body such as muscle pain and fatigue is reduced, and flexible and elastic muscles can be obtained without muscle hardening. In addition, by aerobically promoting metabolism with less forced increase in heart rate and blood pressure, it is effective in preventing lifestyle-related diseases such as diabetes and hypertension, and promoting the healing of ligament damage and fractures, as well as it is possible to create states that are beneficial to the body such as releasing stress on the nerves, the muscles, and the joints and removing waste products.

Situation when First Training Device is Used

The load transmission mechanism unit 1A for training device of the first example was attached to the first training device 100, and a user actually used the first training device. The movements of the wrists and the arms of the user were then photographed at 0.5 second intervals. The photographs in FIGS. 20A to 20E, 21, and 22 are the situations at the time of photography. In each figure, five photographs 20A to 20E are shown.

In the photographs of FIGS. 20A to 20E, the user is in a state where the right hand is put on the grip portion connected to the grip shaft portion of the load transmission mechanism unit for training device. The load transmission mechanism unit for training device is in a raised position due to the load (the weight load) of the device. The situations in which the horizontal direction of the distal end side of the grip shaft portion of the load transmission mechanism unit for training device changes from outward to inward are shown in FIGS. 20A, 20B, 20C, 20D, and 20E, in that order. Initially, the user lifts up and extends the arm, and then gradually bends the arm to pull the load transmission mechanism unit for training device. From the photographs in FIGS. 20C and 20D, the grip shaft portion is inclined to the left side in the drawing. Therefore, due to the arrangement of each device, the twisting angle applied to the user's wrist is alleviated by the inclination of the grip shaft portion, and thus it is possible to parry the movement.

The photographs in FIGS. 21A to 21E show the situations in which the load transmission mechanism unit for training device is pulled down again by the user against the load (the weight load) of the device compared to the position shown in FIGS. 20A to 20E described above. In the order of FIGS. 21A, 21B, 21C, 21D, and 21E, the load transmission mechanism unit for training device is lowered, and furthermore, the direction in the horizontal direction is directed outward.

Figure 22A:
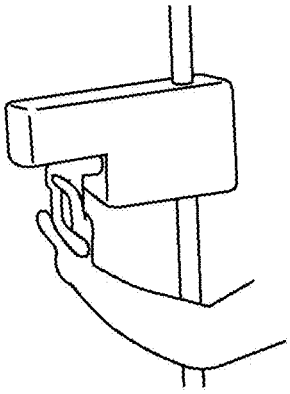
FIG. 22A is an eleventh photograph.
Figure 22B:
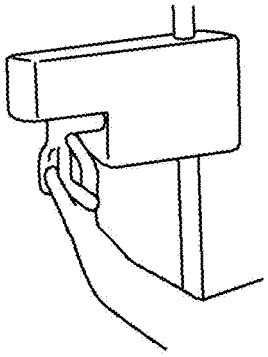
FIG. 22B is a twelfth photograph.
Figure 22C:
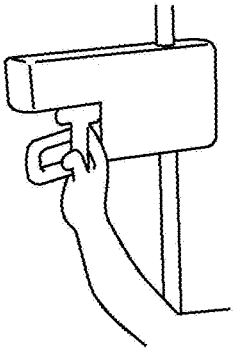
FIG. 22C is a thirteenth photograph.
Figure 22D:
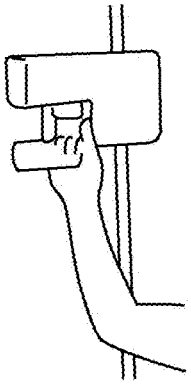
FIG. 22D is a fourteenth photograph.
Figure 22E:
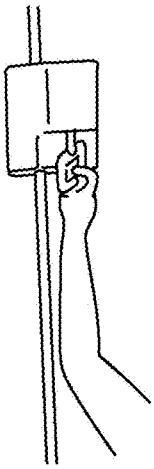
FIG. 22E is a fifteenth photograph of the first training device that includes the load transmission mechanism unit for training device of the first example in use.

The photographs of FIGS. 22A to 22E show the situations in which the user puts his right hand on the grip portion connected to the grip shaft portion of the load transmission mechanism unit for training device and the load transmission mechanism unit for training device is pulled down against the load (the weight load) of the device. As shown in FIG. 22A, the back of the user's right hand is the side facing the body. In FIG. 22A, since the grip shaft portion of the load transmission mechanism unit for training device is swingable, the grip shaft portion is inclined toward the front in the drawing (in the front direction of the user). Then, the load transmission mechanism unit for training device rises in accordance with the load (the weight load) of the training device, and the user's arm is lifted up by being pulled by the grip portion. The situations are shown in the order of FIGS. 22B, 22C, 22D, and 22E.

In the illustrated training device, the grip shaft portion is swingable, and thus, even when the position (the height in the training device) and the direction of the load transmission mechanism unit for training device can be changed from time to time as shown in the photographs in FIGS. 20A to 20E, 21, and 22, it is possible to alleviate the amount of bending applied to the wrist of the user who grips the grip portion, and it is thought that the burden on the wrist will be reduced. In addition to the training device in which the load transmission mechanism unit 1A for training device of the first example is applied to the first training device 100 shown in the illustrated photograph, even in the training device in which the load transmission mechanism unit 1B for training device or 1C of the second example is applied to the second training device 200, it is expected that the amount of bending applied to the wrist of a user who grips the grip portion during the movement of the training device will be alleviated.

As described above, the load transmission mechanism unit for training device of the example was attached to an actual training device, and the movement or the like through the user was verified. As a result, the load of twisting that is applied to the wrist of the user who grips the grip portion is alleviated by the swing of the shaft itself in addition to the turning of the grip shaft portion (the grip portion) itself of the load transmission mechanism unit for training device of the related art, and thus the user can perform the training movements more naturally. Therefore, it becomes possible to move more effortlessly during training than ever before, and it is easy to smooth the series of muscle movements of "the relaxation, the stretching, and the shortening."

Verification of Load Transmission Mechanism Unit for Training Device

I connected the load transmission mechanism unit 1A for training device described above (see FIG. 1) to the first training device 100 (see FIGS. 10 to 15). Then, the grip shaft portion 10 was set to a swingable state, and a test subject was trained using the first training device 100, and a myoelectric potential was measured. At the same time, the grip shaft portion 10 was set to a non-swingable state using the regulating plate portion 5 in the load transmission mechanism unit 1A for training device, and the test subject was trained using the first training device 100, and the myoelectric potential was measured.

Figure 23A:
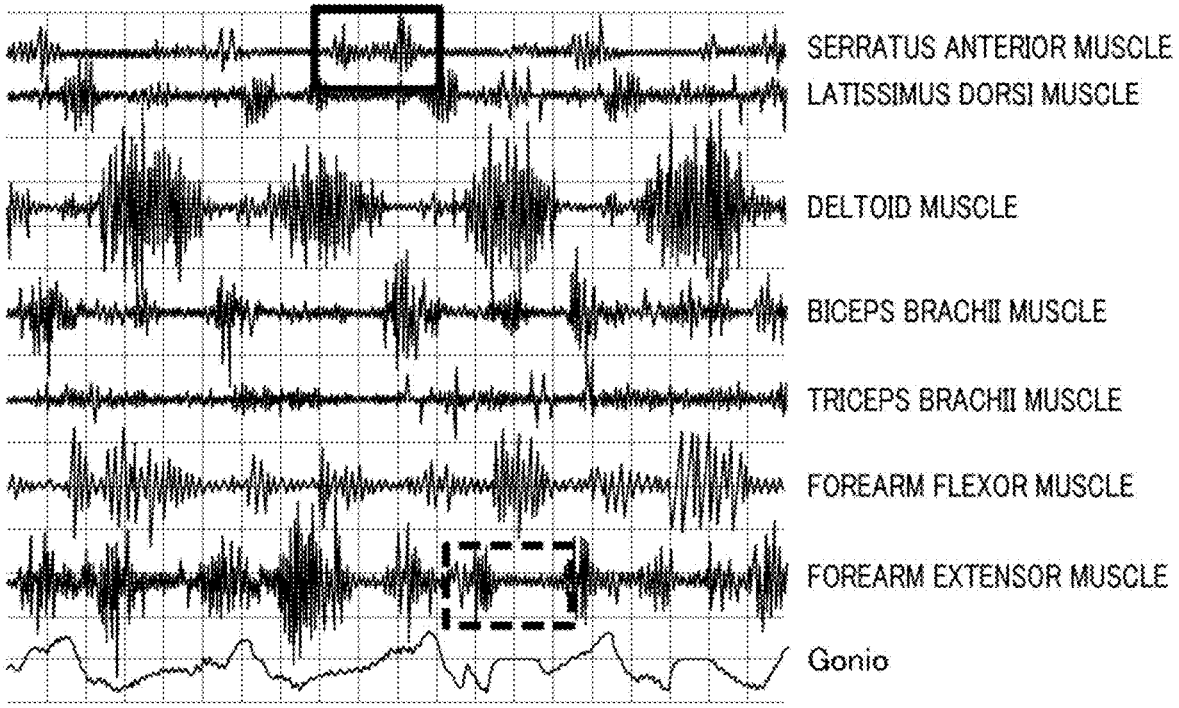
FIG. 23A is a graph of an electromyogram when there is a swing of a grip shaft portion.
Figure 23B:
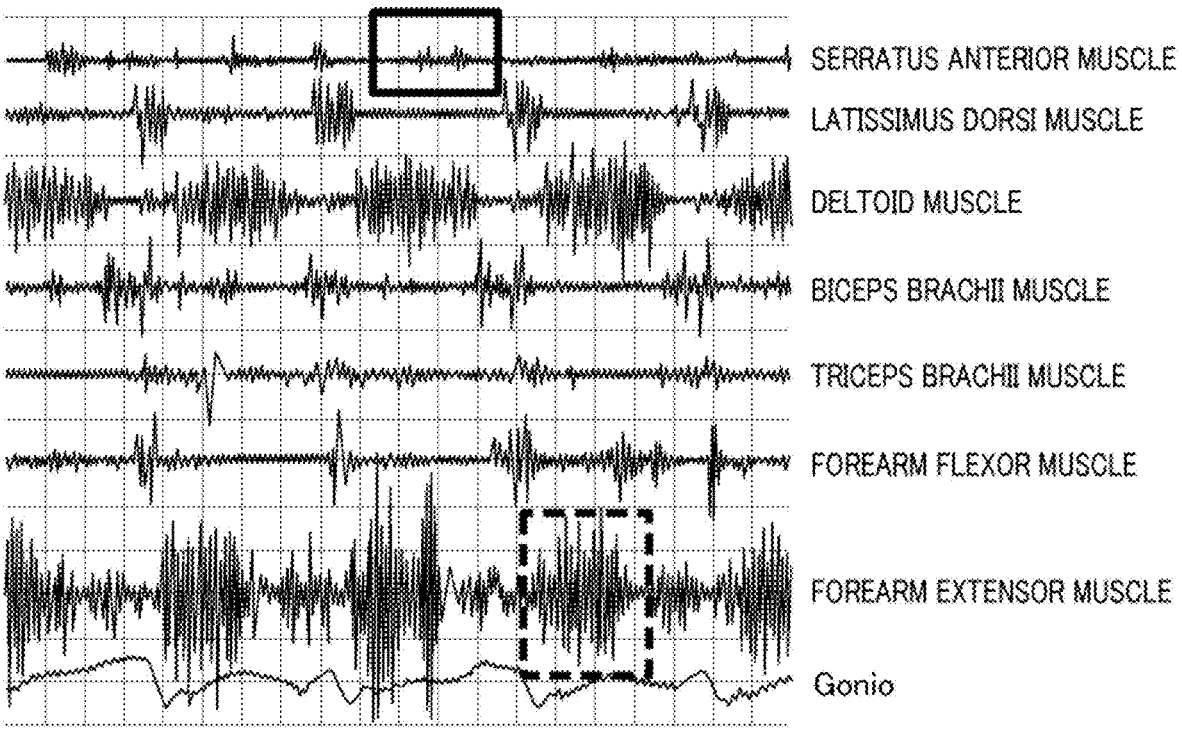
FIG. 23B is a graph of an electromyogram when there is no swing of the grip shaft portion.

The measurement results of the myoelectric potential are shown in graphs of FIGS. 23A and 23B. FIG. 23A is a graph of an electromyogram when there is a swing of the grip shaft portion, and FIG. 23B is a graph of an electromyogram when there is no swing of the grip shaft portion. In both graphs, from the top, there are "serratus anterior muscle, latissimus dorsi muscle, deltoid muscle (middle), biceps brachii muscle, triceps brachii muscle, forearm flexor muscle (palmaris longus muscle), forearm extensor muscle (flexor carpi radialis extensor muscle), and Gonio (an angle meter)."

When the grip shaft portion 10 is in a swingable state, the activity of the serratus anterior muscle becomes active (see the solid line frame in both figures). On the other hand, when the grip shaft portion 10 is in a non-swingable state, the activity of the forearm flexor muscle becomes active (see the dashed line frame in both figures). That is, by selecting whether or not to swing the grip shaft portion 10, it is possible to adjust the muscles to be trained. For this reason, it is possible to flexibly respond to individual factors such as the physical condition, the physique, and the muscles to be strengthened of the user training.

This application is a continuation application of International Application No. PCT/JP2021/048581, filed on Dec. 27, 2021, which claims priority of Japanese Patent Application No. 2021-132129, filed on Aug. 16, 2021, the contents of which are incorporated herein by reference in their entirety.

What is claimed is:

1. A load transmission mechanism unit for a training device, comprising, in a housing portion:

a grip shaft portion that rotates with a grip portion, which is configured to be gripped by a user, connected to a first end portion thereof;

an intermediate shaft portion that rotates in conjunction with rotation of the grip shaft portion;

a transmission portion suspended between the grip shaft portion and the intermediate shaft portion and transmits a mutual rotation of the grip shaft portion and the intermediate shaft portion; and a rotation conversion portion provided on a crank shaft portion orthogonal to the intermediate shaft portion and transmits rotation of the intermediate shaft portion;

wherein the crank shaft portion converts rotation of the crank shaft portion into a vertical movement of a sliding shaft portion disposed at a position parallel to the intermediate shaft portion, the first end portion of the grip shaft portion protrudes from a shaft opening portion formed in the housing portion in a direction orthogonal to the transmission portion, and the first end portion of the grip shaft portion is swingably supported by the housing portion, and a second end portion of the grip shaft portion on a side opposite to the first end portion swings within the shaft opening portion.

2. The load transmission mechanism unit according to claim 1, wherein the rotation conversion portion includes:

an intermediate shaft bevel gear provided on the intermediate shaft portion, and a crank shaft bevel gear provided on the crank shaft portion that meshes with the intermediate shaft bevel gear, wherein a connecting piece portion is rotatably connected to the crank shaft portion, wherein the sliding shaft portion is connected to the connecting piece portion and is disposed at a position parallel to the intermediate shaft portion, and wherein through the sliding shaft portion and accommodated in the housing portion, the rotation of the crank shaft portion is converted into a back-and-forth movement via the connecting piece portion.

3. The load transmission mechanism unit according to claim 1, wherein the housing portion includes a regulating plate portion that regulates a swing of the grip shaft portion on the first end portion in the shaft opening portion.

4. The load transmission mechanism unit according to claim 3, wherein the regulating plate portion includes a claw portion and engages with the grip shaft portion through the claw portion.

5. The load transmission mechanism unit according to claim 4, wherein the regulating plate portion advances toward the shaft opening portion and engages with the grip shaft portion through the claw portion, and the regulating plate portion retreats from the shaft opening portion and disengages from the first end portion of the grip shaft portion.

6. The load transmission mechanism unit according to claim 1, wherein the transmission portion is a transmission chain, the grip shaft portion includes a grip shaft sprocket, the intermediate shaft portion includes an intermediate shaft sprocket, and the transmission chain is suspended between the grip shaft sprocket and the intermediate shaft sprocket.

7. The load transmission mechanism unit according to claim 1, further comprising a biasing shaft portion that biases tension of the transmission portion between the grip shaft portion and the intermediate shaft portion.

8. The load transmission mechanism unit according to claim 7, wherein the biasing shaft portion includes a disk portion in contact with the transmission portion.

9. The load transmission mechanism unit according to claim 1, wherein the grip portion is an annular object.

10. The load transmission mechanism unit according to claim 1, wherein the grip portion is a semi-cylindrical object.

11. The load transmission mechanism unit according to claim 1, wherein the second end portion of the grip shaft portion includes a spherical portion.

12. The load transmission mechanism unit according to claim 1, wherein the sliding shaft portion is connected to a load applying portion that can adjust a magnitude of a load of the training device.

13. The load transmission mechanism unit according to claim 1, wherein the housing portion includes a connection portion for connecting to the training device.

14. A training device comprising the load transmission mechanism unit according to claim 1.

* * * * *